US012453909B2

(12) United States Patent
Spackman et al.

(10) Patent No.: US 12,453,909 B2
(45) **Date of Patent: *Oct. 28, 2025**

(54) GOLF CLUB HEAD FACEPLATES WITH LATTICES

(71) Applicant: KARSTEN MANUFACTURING CORPORATION, Phoenix, AZ (US)

(72) Inventors: Clayson C. Spackman, Scottsdale, AZ (US); Matthew W. Simone, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/460,469

(22) Filed: Sep. 1, 2023

(65) Prior Publication Data

US 2023/0405419 A1 Dec. 21, 2023

Related U.S. Application Data

(63) Continuation of application No. 17/373,603, filed on Jul. 12, 2021, now Pat. No. 11,745,062, which is a (Continued)

(51) Int. Cl.
*A63B 53/04* (2015.01)

(52) U.S. Cl.
CPC ..... *A63B 53/0466* (2013.01); *A63B 53/0412* (2020.08); *A63B 53/0437* (2020.08); *A63B 53/0445* (2020.08); *A63B 2209/00* (2013.01)

(58) Field of Classification Search
CPC ... A63B 53/04; A63B 53/0416; A63B 53/042; A63B 2053/0445; A63B 2053/0454; A63B 53/0458
(Continued)

(56) References Cited

U.S. PATENT DOCUMENTS 1,094,599 A 4/1914 Samson
3,814,437 A * 6/1974 Winquist ..... A63B 60/00 473/324
(Continued)

FOREIGN PATENT DOCUMENTS

CN 202666332 1/2013
CN 102223927 B * 11/2014 ..... A63B 53/04
(Continued)

OTHER PUBLICATIONS

International Search Report and Written Opinion for PCT Application No. PCT/US2012/038689, 9 pages, Nov. 23, 2012.
(Continued)

*Primary Examiner* — Alvin A Hunter

(57) ABSTRACT

Embodiments of golf club head faceplates comprising a lattice to improve the energy storage capabilities and minimize stress concentrations are described herein. The lattice can comprise a plurality of flexure shapes that facilitate in faceplate bending. The flexure shapes of the lattice can comprise a reentrant, concave, or non-convex shape. The lattice can comprise at least one repeating pattern of flexure shapes that can be interconnected or spaced apart. During golf ball impacts, the flexure shapes flex to store energy through linear and torsional bending.

19 Claims, 17 Drawing Sheets

Related U.S. Application Data continuation of application No. 16/880,865, filed on May 21, 2020, now Pat. No. 11,058,929, which is a continuation of application No. 16/510,737, filed on Jul. 12, 2019, now Pat. No. 10,675,517.

(60) Provisional application No. 62/697,304, filed on Jul. 12, 2018.

(58) Field of Classification Search
USPC ..... 473/329, 342, 350; D21/747, 748, 749
See application file for complete search history.

(56) References Cited

U.S. PATENT DOCUMENTS 4,630,826 A 12/1986 Nishigaki
4,681,322 A 7/1987 Straza
4,749,197 A * 6/1988 Orlowski ..... A63B 60/00 473/342
4,919,430 A * 4/1990 Antonious ..... A63B 53/04 473/350
4,930,781 A * 6/1990 Allen ..... A63B 60/00 164/34
4,932,658 A * 6/1990 Antonious ..... A63B 53/04 473/350
5,242,167 A * 9/1993 Antonious ..... A63B 53/047 473/350
5,301,941 A 4/1994 Allen
5,377,986 A 1/1995 Viollaz
5,397,126 A * 3/1995 Allen ..... A63B 60/00 473/324
5,401,021 A * 3/1995 Allen ..... A63B 53/047 473/291
5,405,137 A * 4/1995 Vincent ..... A63B 53/04 473/342
5,425,538 A 6/1995 Vincent
5,497,993 A 3/1996 Shan
5,499,814 A 3/1996 Lu
5,601,501 A * 2/1997 Kobayashi ..... A63B 53/04 473/350
5,611,742 A * 3/1997 Kobayashi ..... A63B 60/52 473/331
5,643,108 A * 7/1997 Cheng ..... A63B 53/04 473/347
5,649,872 A * 7/1997 Antonious ..... A63B 60/00 D21/748
5,665,013 A * 9/1997 Kobayashi ..... A63B 53/047 473/331
5,669,829 A * 9/1997 Lin ..... A63B 53/0466 473/346
5,676,605 A * 10/1997 Kobayashi ..... A63B 60/00 473/331
5,681,227 A 10/1997 Sayrizi
5,711,722 A * 1/1998 Miyajima ..... A63B 53/0466 473/346
5,735,755 A * 4/1998 Kobayashi ..... A63B 53/04 473/331
5,766,094 A * 6/1998 Mahaffey ..... A63B 60/00 473/347
5,776,011 A * 7/1998 Su ..... A63B 53/0466 473/345
5,799,859 A * 9/1998 Cheng ..... A63B 60/00 228/157
5,807,190 A 9/1998 Krumme
5,827,131 A 10/1998 Mahaffey
D404,779 S * 1/1999 Knox ..... D21/747
5,944,619 A 8/1999 Cameron
5,971,868 A * 10/1999 Kosmatka ..... A63B 69/3635 473/324
6,001,495 A 12/1999 Bristow
6,074,309 A * 6/2000 Mahaffey ..... A63B 53/0466 473/345
6,114,050 A 9/2000 Westre
D431,622 S * 10/2000 Sato ..... D21/748
6,179,726 B1 * 1/2001 Satoh ..... A63B 53/04 473/290
6,183,381 B1 2/2001 Grant
6,240,640 B1 6/2001 Matsuoka
6,299,548 B1 * 10/2001 Lin ..... A63B 53/0466 473/331
6,319,150 B1 11/2001 Werner
6,322,459 B1 * 11/2001 Nishimura ..... A63B 60/00 473/331
6,334,818 B1 * 1/2002 Cameron ..... A63B 53/0487 473/332
6,379,262 B1 * 4/2002 Boone ..... A63B 53/04 473/324
6,458,043 B1 * 10/2002 McCabe ..... A63B 60/00 473/345
D484,557 S * 12/2003 Lang ..... D21/747
6,681,612 B2 * 1/2004 Matsumoto ..... A63B 53/0466 72/352
D486,871 S 2/2004 Burrows
D497,963 S * 11/2004 Toulon ..... D21/747
6,932,716 B2 8/2005 Ehlers
6,979,270 B1 * 12/2005 Allen ..... A63B 53/0466 473/290
6,986,915 B2 1/2006 Bourdages
6,997,820 B2 2/2006 Willett
7,018,303 B2 * 3/2006 Yamamoto ..... A63B 60/52 473/329
7,066,833 B2 * 6/2006 Yamamoto ..... A63B 60/00 473/331
7,108,614 B2 9/2006 Lo
7,112,147 B2 9/2006 Solheim
7,169,062 B2 * 1/2007 Chen ..... A63B 53/0466 473/329
7,281,990 B2 10/2007 Hagood
7,367,898 B2 5/2008 Hawkins
7,367,899 B2 5/2008 Rice
7,387,579 B2 * 6/2008 Lin ..... A63B 53/04 473/332
7,448,961 B2 11/2008 Lin
7,461,726 B2 12/2008 Hawkins
7,500,923 B2 3/2009 Tateno
7,527,565 B1 5/2009 Ehlers
7,575,524 B2 * 8/2009 Willett ..... A63B 53/047 473/345
7,607,992 B2 * 10/2009 Nishio ..... A63B 53/0466 473/347
7,614,964 B2 * 11/2009 Matsunaga ..... A63B 60/00 473/346
7,618,331 B2 * 11/2009 Hirano ..... A63B 60/00 473/346
7,708,653 B2 5/2010 Hawkins
7,794,335 B2 * 9/2010 Cole ..... A63B 53/047 473/346
7,846,039 B2 12/2010 Gilbert
7,874,936 B2 1/2011 Chao
7,914,394 B2 * 3/2011 Cole ..... A63B 53/047 473/332
7,946,929 B2 5/2011 Wahlin
8,007,373 B2 8/2011 Soracco
8,070,623 B2 * 12/2011 Stites ..... A63B 53/0466 473/346
8,221,264 B2 * 7/2012 Cole ..... A63B 53/047 473/342
8,235,842 B2 * 8/2012 Cole ..... A63B 53/047 473/332
8,323,122 B2 12/2012 Soracco
8,337,324 B2 12/2012 Sander
8,337,329 B2 * 12/2012 Wada ..... A63B 53/0466 473/345
8,439,769 B2 5/2013 Rice
8,469,834 B2 * 6/2013 Wada ..... A63B 53/0466 473/346
8,616,998 B2 * 12/2013 Cole ..... A63B 53/04 473/332
8,663,027 B2 * 3/2014 Morales ..... A63B 60/00 473/345

(56) References Cited

U.S. PATENT DOCUMENTS 8,727,908 B2 * 5/2014 Goto ..... A63B 53/04 473/329
8,777,778 B2 7/2014 Solheim
8,790,196 B2 7/2014 Solheim
9,089,747 B2 7/2015 Boyd
9,138,619 B2 * 9/2015 Takechi ..... A63B 53/0466
9,144,725 B2 9/2015 Hocknell
9,194,452 B2 11/2015 Hawkins
9,199,138 B2 12/2015 Willett
9,199,139 B2 * 12/2015 Kronenberg ..... A63B 53/0466
9,220,959 B2 12/2015 Roach
9,330,406 B2 5/2016 Soracco
9,370,697 B2 * 6/2016 Beno ..... A63B 60/00
9,409,065 B2 * 8/2016 Morales ..... A63B 53/0466
9,669,270 B2 * 6/2017 Schweigert ..... A63B 60/00
9,724,575 B2 * 8/2017 Morin ..... A63B 60/00
9,878,217 B2 * 1/2018 Morales ..... B23K 20/233
9,889,347 B2 * 2/2018 Morales ..... B32B 3/12
10,195,492 B2 2/2019 Campbell
10,322,320 B2 * 6/2019 Morales ..... B23K 20/023
10,335,646 B2 * 7/2019 Morales ..... A63B 53/04
10,335,653 B1 * 7/2019 Daraskavich ..... B23K 11/115
10,343,031 B1 * 7/2019 Day ..... A63B 53/0433
10,518,144 B1 * 12/2019 Daraskavich ..... B23K 11/093
10,675,517 B2 * 6/2020 Spackman ..... A63B 53/0466
10,716,977 B2 7/2020 Aplin
10,737,147 B2 * 8/2020 Morales ..... A63B 53/04
10,835,786 B2 * 11/2020 Morales ..... A63B 53/04
11,058,929 B2 * 7/2021 Spackman ..... A63B 60/48
11,247,104 B2 * 2/2022 Morales ..... B23K 20/023
11,484,755 B2 * 11/2022 Morales ..... A63B 53/0466
11,511,166 B1 * 11/2022 Roach ..... A63B 53/0454
11,724,162 B2 * 8/2023 Morales ..... B23K 20/021 473/331
11,745,062 B2 * 9/2023 Spackman ..... A63B 53/0458 473/329
11,925,839 B2 * 3/2024 Morales ..... B23K 20/233
12,128,277 B2 * 10/2024 Roach ..... B29C 64/40
2001/0001774 A1 * 5/2001 Antonious ..... A63B 60/00 473/349
2002/0019265 A1 * 2/2002 Allen ..... A63B 53/04 473/346
2002/0025861 A1 * 2/2002 Ezawa ..... A63B 53/047 473/342
2002/0037776 A1 3/2002 Krumme
2002/0155900 A1 * 10/2002 McCabe ..... A63B 60/00 473/330
2003/0027660 A1 * 2/2003 McCabe ..... A63B 53/08 473/345
2004/0009829 A1 1/2004 Kapilow
2004/0219991 A1 * 11/2004 Suprock ..... A63B 53/0466 473/345
2004/0235585 A1 * 11/2004 Sanchez ..... A63B 53/04 473/346
2006/0046868 A1 * 3/2006 Murphy ..... A63B 53/0466 473/332
2007/0004525 A1 * 1/2007 Lee ..... A63B 60/52 473/242
2007/0178991 A1 * 8/2007 Hou ..... A63B 53/0466 473/349
2007/0225086 A1 * 9/2007 Lin ..... A63B 60/00 473/345
2007/0259736 A1 11/2007 Lo
2008/0039230 A1 2/2008 Lin
2008/0045356 A1 * 2/2008 Lin ..... A63B 53/0466 473/346
2008/0125246 A1 * 5/2008 Matsunaga ..... A63B 60/00 473/346
2008/0139334 A1 * 6/2008 Willett ..... A63B 53/0466 473/329
2008/0242444 A1 * 10/2008 Park ..... A63B 53/0475 473/332
2010/0267466 A1 10/2010 Stites
2012/0289360 A1 * 11/2012 Breier ..... A63B 53/047 473/335
2013/0072321 A1 * 3/2013 Morales ..... B23K 20/233 228/159
2013/0344986 A1 * 12/2013 DeMille ..... A63B 60/00 473/346
2014/0038737 A1 * 2/2014 Roach ..... A63B 53/04 473/226
2014/0135144 A1 * 5/2014 Morales ..... B23K 20/233 228/178
2014/0256462 A1 * 9/2014 Cole ..... A63B 53/0466 473/332
2015/0246268 A1 9/2015 Abe
2016/0263449 A1 * 9/2016 Morales ..... A63B 53/0416
2016/0317881 A1 * 11/2016 Morales ..... B23K 20/023
2018/0117424 A1 * 5/2018 Morales ..... A63B 53/0466
2018/0117426 A1 * 5/2018 Morales ..... B23K 20/02
2019/0262668 A1 * 8/2019 Morales ..... A63B 53/0416
2019/0275387 A1 * 9/2019 Morales ..... B23K 20/233
2020/0070017 A1 * 3/2020 Aplin ..... B22F 1/108
2020/0346077 A1 * 11/2020 Aplin ..... B22F 1/108
2020/0368588 A1 * 11/2020 Morales ..... A63B 53/04
2021/0069556 A1 * 3/2021 Morales ..... B23K 20/023
2021/0077865 A1 * 3/2021 Morales ..... A63B 60/02
2022/0161105 A1 * 5/2022 Morales ..... A63B 53/0466
2023/0381601 A1 * 11/2023 Morales ..... B23K 20/023
2024/0216765 A1 * 7/2024 Morales ..... B32B 3/12

FOREIGN PATENT DOCUMENTS

GB 2554320 A * 3/2018 ..... A63B 53/04
GB 2554320 B * 6/2021 ..... A63B 53/04
JP 06233837 A * 8/1994
JP H06233837 8/1994
JP H09299521 8/1994
JP 09038248 A * 2/1997 ..... A63B 53/04
JP 09038252 A * 2/1997 ..... A63B 53/04
JP H09038248 2/1997
JP H09038252 2/1997
JP 09154985 A * 6/1997 ..... A63B 53/0466
JP 09187535 A * 7/1997 ..... A63B 53/04
JP H09187535 7/1997
JP 09239075 A * 9/1997 ..... A63B 53/0466
JP 09276456 A * 10/1997 ..... A63B 53/04
JP H09276456 10/1997
JP 09299521 A * 11/1997
JP 2002065909 A * 3/2002 ..... A63B 53/0466
JP 2002165905 6/2002
JP H3333386 10/2002
JP 2004089567 3/2004
JP 2004089567 A * 3/2004
JP 2005052400 A * 3/2005 ..... A63B 53/0466
JP 2010253247 A * 11/2010 ..... A63B 53/0466
JP 2012120676 A * 6/2012 ..... A63B 53/0466
JP 2016195818 A * 11/2016 ..... A63B 53/04
JP 6068477 B2 * 1/2017 ..... A63B 53/04
JP 2017086766 5/2017
JP 6301404 B2 * 3/2018 ..... A63B 53/04
JP 2018126521 A * 8/2018 ..... A63B 53/04
JP 6396617 B2 * 9/2018 ..... A63B 53/04
JP 6639526 B2 * 2/2020 ..... A63B 53/04
WO WO-2013043240 A1 * 3/2013 ..... A63B 53/04
WO WO-2016191390 A1 * 12/2016 ..... A63B 53/04
WO WO-2020014678 A1 * 1/2020 ..... A63B 53/0408

OTHER PUBLICATIONS

International Search Report and Written Opinion for PCT Application No. PCT/US2016/033822, 8 pages, Aug. 19, 2016.

Saxema et al., Three Decades of Auxetics Research—Materials with Negative Poisson's Ratio: A Review, 18, Advanced Engineering Materials, 1847-1870 (2016).

* cited by examiner

GOLF CLUB HEAD FACEPLATES WITH LATTICES

CROSS REFERENCE TO RELATED APPLICATIONS

This is a continuation of U.S. patent application Ser. No. 17/373,603, filed on Jul. 12, 2021, which is a continuation of U.S. patent application Ser. No. 16/880,865, filed on May 21, 2020, and is issued as U.S. Pat. No. 11,058,929 on Jul. 13, 2021, which is a continuation of U.S. patent application Ser. No. 16/510,737, filed on Jul. 12, 2019, and is issued as U.S. Pat. No. 10,675,517 on Jun. 9, 2020, which claims the benefit of U.S. Provisional Patent Application No. 62/697,304, filed on Jul. 12, 2018. The contents of all the above-described disclosures are incorporated fully herein by reference in their entirety.

FIELD OF THE INVENTION

This invention generally relates to golf club head faceplates with lattices.

BACKGROUND

Golf club design takes into account several performance characteristics, such as ball speed. Typically, golf club designs aim to increase ball speed by increasing the deflection or flexibility capabilities of the faceplate. However, current designs are limited due to manufacturing or structural considerations. Therefore, there is a need in the art for a club head with a faceplate that further increases ball speed while minimizing stress concentrations.

Figure 1:
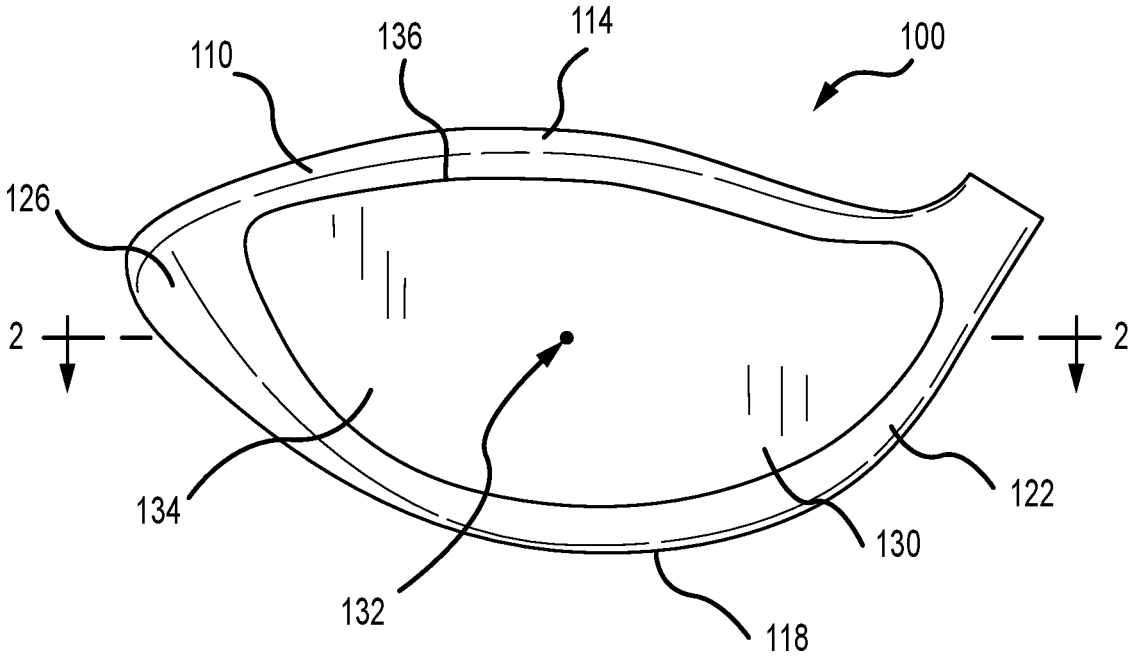
FIG. 1 illustrates a front view of a golf club head faceplate according to an embodiment.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf club heads with lattices. The same reference numerals in different figures denote the same elements.

DETAILED DESCRIPTION

The present embodiments discussed below are directed to golf club head faceplates comprising a lattice. The lattice comprises a plurality of flexure shapes that facilitate faceplate bending. The flexure shapes of the lattice comprise a reentrant shape (i.e. shape that points inward), a concave shape, or a non-convex shape. The lattice comprises a repeating pattern of flexure shapes that can be interconnected or spaced apart from one another. The dimensions, the shape, and the pattern of the lattice affects the bending of the faceplate during golf ball impacts. During golf ball impacts, the flexure shapes of the lattice act as tiny springs that store energy through linear and torsional bending. Storing energy through two modes of bending provides greater energy storage in the faceplate, which allows for greater ball speeds during golf ball impacts. Further, the flexure shapes of the lattice reduce the largest stresses concentrated in a small volume of the faceplate material (i.e. impact area of the faceplate) by displacing the reduced stress over a greater volume of the faceplate material. This allows the largest stresses to be moved away from an impact area of the faceplate thereby increasing the faceplate durability. The combination of spreading the stress over a larger volume of faceplate material and the two modes of bending leads to a 1 to 3 mph increase in ball speed.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "loft" or "loft angle" of a golf club, as described herein, refers to the angle formed between the club face and the shaft, as measured by any suitable loft and lie machine.

Embodiments of a golf club head are described herein, wherein the golf club head can comprise a driver-type club head, a fairway wood-type club head, or a hybrid-type club head. For example, in some embodiments, the golf club head can comprise a driver-type club head. The driver-type club head comprises a loft angle and a volume. In many embodiments, the loft angle of the driver-type club head is less than approximately 16 degrees, less than approximately 15 degrees, less than approximately 14 degrees, less than approximately 13 degrees, less than approximately 12 degrees, less than approximately 11 degrees, or less than approximately 10 degrees. Further, in many embodiments, the volume of the driver-type club head is greater than approximately 400 cc, greater than approximately 425 cc, greater than approximately 445 cc, greater than approximately 450 cc, greater than approximately 455 cc, greater than approximately 460 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the driver-type club head can be approximately 400 cc-600 cc, 425 cc-500 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

For further example, in some embodiments, the golf club head can comprise a fairway wood-type club head. The fairway wood-type club head comprises a loft angle and a volume. In many embodiments, the loft angle of the fairway wood-type club head is less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the fairway wood-type club head is greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in some embodiments, the loft angle of the fairway wood-type club head can be between 12 degrees and 35 degrees, between 15 degrees and 35 degrees, between 20 degrees and 35 degrees, or between 12 degrees and 30 degrees.

Further, in many embodiments, the volume of the fairway wood-type club head is less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In some embodiments, the volume of the fairway wood-type club head can be approximately 150 cc-200 cc, approximately 150 cc-250 cc, approximately 150 cc-300 cc, approximately 150 cc-350 cc, approximately 150 cc-400 cc, approximately 300 cc-400 cc, approximately 325 cc-400 cc, approximately 350 cc-400 cc, approximately 250 cc-400 cc, approximately 250-350 cc, or approximately 275-375 cc.

For further example, in some embodiments, the golf club head can comprise a hybrid-type club head. The hybrid-type club head comprises a loft angle and a volume. In many embodiments, the loft angle of the hybrid-type club head is less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the hybrid-type club head is greater than approximately 16 degrees, greater than approximately 17 degrees, greater than approximately 18 degrees, greater than approximately 19 degrees, greater than approximately degrees, greater than approximately 21 degrees, greater than approximately 22 degrees, greater than approximately 23 degrees, greater than approximately 24 degrees, or greater than approximately 25 degrees.

Further, in many embodiments, the volume of the hybrid-type club head is less than approximately 200 cc, less than approximately 175 cc, less than approximately 150 cc, less than approximately 125 cc, less than approximately 100 cc, or less than approximately 75 cc. In some embodiments, the volume of the hybrid-type club head can be approximately 100 cc-150 cc, approximately 75 cc-150 cc, approximately 100 cc-125 cc, or approximately 75 cc-125 cc.

For ease of discussion and understanding, and for purposes of description only, the following detailed description illustrates a golf club head as a driver. It should be appreciated that the driver is provided for purposes of illustration of the faceplate lattices with the purpose of increasing ball speed. As described above, the disclosed faceplate with lattices can be used in association with any desired driver, fairway wood, hybrid, or wood generally.

Other features and aspects will become apparent by consideration of the following detailed description and accompanying drawings. Before any embodiments of the disclosure are explained in detail, it should be understood that the disclosure is not limited in its application to the details or embodiment and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

Golf Club Head Faceplates with Lattice

Described herein is a golf club head faceplate comprising a lattice. The lattice comprises a plurality of flexure shapes that facilitate in faceplate bending. During golf ball impacts, the flexure shapes of the faceplate lattice act as tiny springs that store energy through linear and torsional bending. Storing energy through two modes of bending allows for greater faceplate energy storage, which results in greater ball speeds during golf ball impacts. Further, the flexure shapes of the lattice reduce the largest stresses that occur over a small volume of the faceplate material and displaces the reduced stress over a greater volume of the faceplate material.

Referring to the drawings, wherein like reference numerals are used to identify like or identical components in various views, FIG. 1 schematically illustrates a front view of a golf club head 100. The golf club head 100 includes a faceplate 130 and a body 110 that are secured together to define a substantially closed/hollow interior volume. The club head 100 includes a crown 114, a sole 118 opposite the crown 114, a heel 122, and a toe 126 opposite the heel 122.

Figure 2:
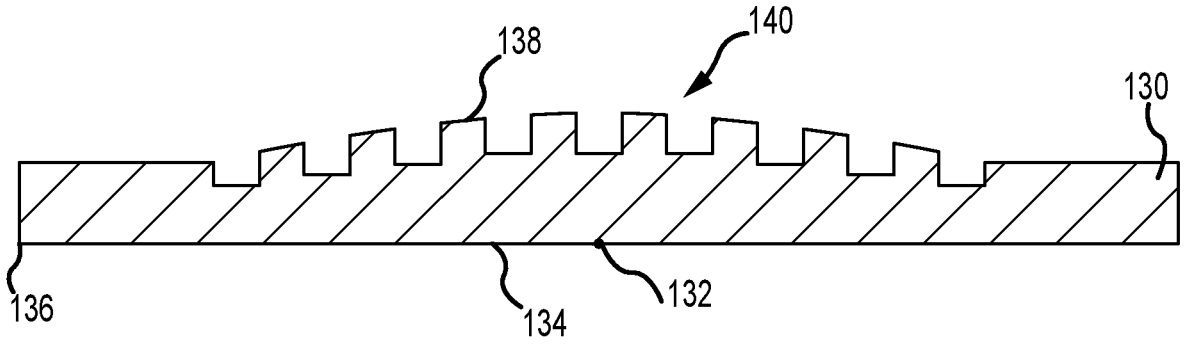
FIG. 2 illustrates a cross sectional view of the golf club head of FIG. 1.

As illustrated in FIGS. 1 and 2, the faceplate 100 includes a strike face 134 intended to impact a golf ball, and a back face 138 opposite the strike face 134. The faceplate 130 further comprises a center 132 located at a geometric center of the faceplate 130, and a perimeter 136 that extends entirely around the faceplate 130 near the crown 114, toe 126, sole 118, and heel 122 of the club head 100.

To withstand the impact stresses that occur when club head 100 strikes a golf ball, the faceplate 130 is formed from a metal, or metal alloy, and preferably a light-weight metal alloy, such as, for example, a stainless steel or steel alloy, for example, but not limited to, C300, C350, Ni (Nickel)-Co (Cobalt)-Cr(Chromium)-Steel Alloy, 565 Steel, AISI type 304 or AISI type 630 stainless steel, a titanium alloy, for example, but not limited to Ti-6-4, Ti-3-8-6-4-4, Ti-10-2-3, Ti 15-3-3-3, Ti 15-5-3, Ti185, Ti 6-6-2, Ti-7s, Ti-9s, Ti-92, or Ti-8-1-1 Titanium alloy, an amorphous metal alloy, or other similar metals.

The faceplate of the club head 100 further includes a lattice 140 having a plurality of flexure shapes recessed into the faceplate 130. The lattice 140 can be recessed into the back face 138 of the faceplate 130. The lattice 140 can be located within the closed/hollow interior volume of the club head 100, where the lattice 140 is not exposed or visible to an exterior surface of the club head 100.

Figure 3:
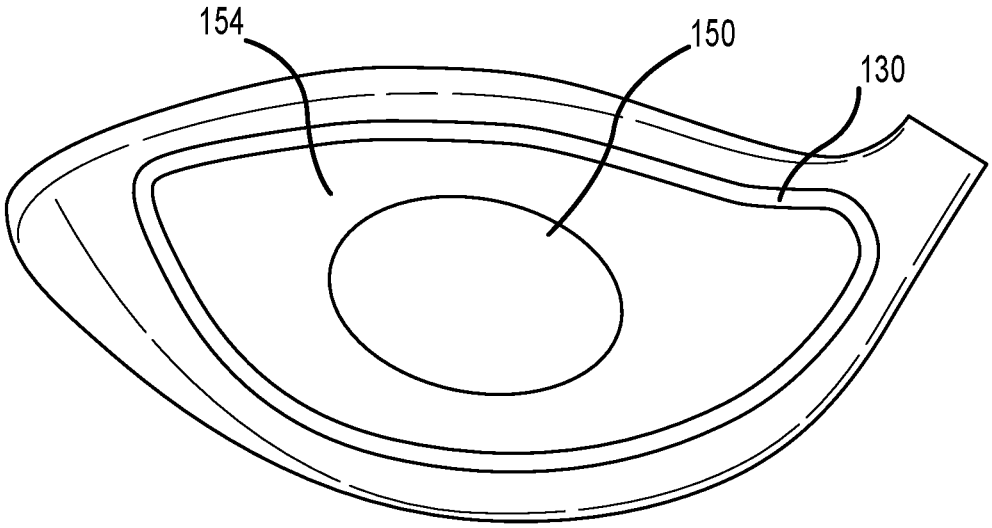
FIG. 3 illustrates a front view of a golf club head faceplate subdivided into different faceplate regions.
Figure 4:
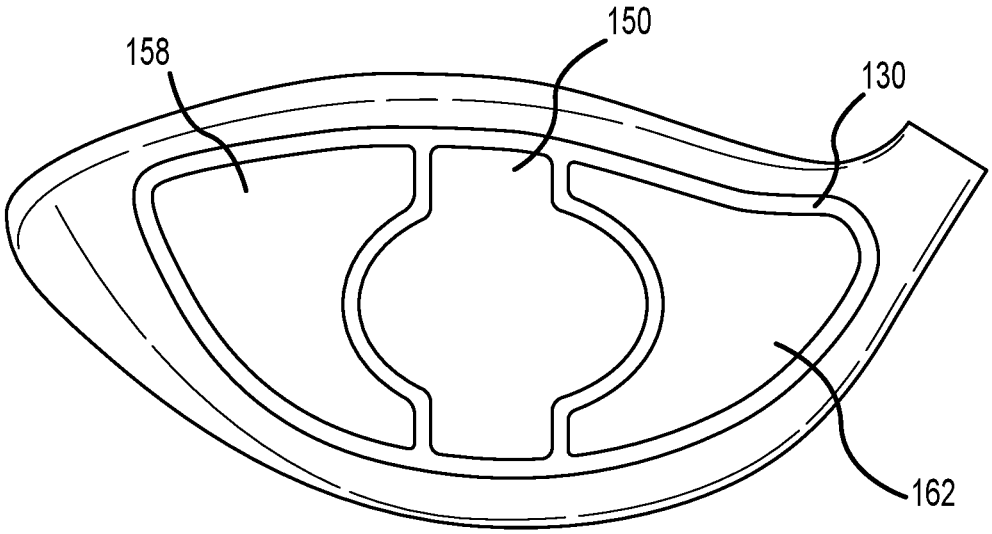
FIG. 4 illustrates a front view of a golf club head faceplate subdivided into different faceplate regions.
Figure 5:
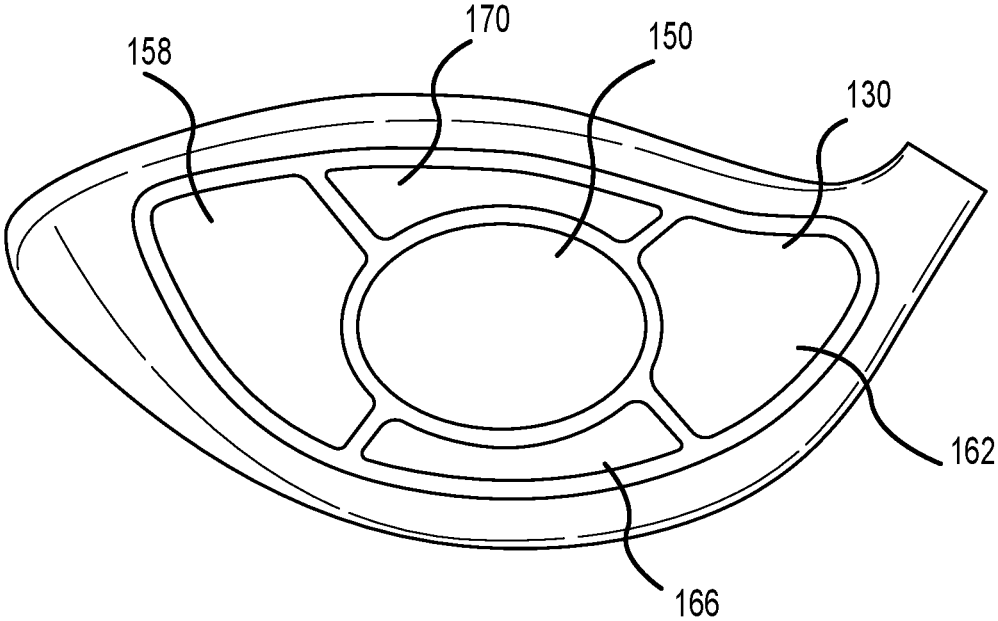
FIG. 5 illustrates a front view of a golf club head faceplate subdivided into different faceplate regions.

As illustrated in FIGS. 3-5, the lattice 140 can be positioned in a region of the faceplate 130. The faceplate 130 can comprise a center region 150 located near the faceplate center 132 of the faceplate 130, a toe region 158 located near the toe 126 of the club head 100, a heel region 162 located near the heel 162 of the club head 100, a bottom region 166 located near the sole 118 of the club head 100, and a top region 170 located near the crown 114 of the club head 100. The lattice 140 can be positioned on the center region 150, the toe region 158, the heel region 162, the bottom region 166, the top region 170, or any combination thereof.

Figure 6:
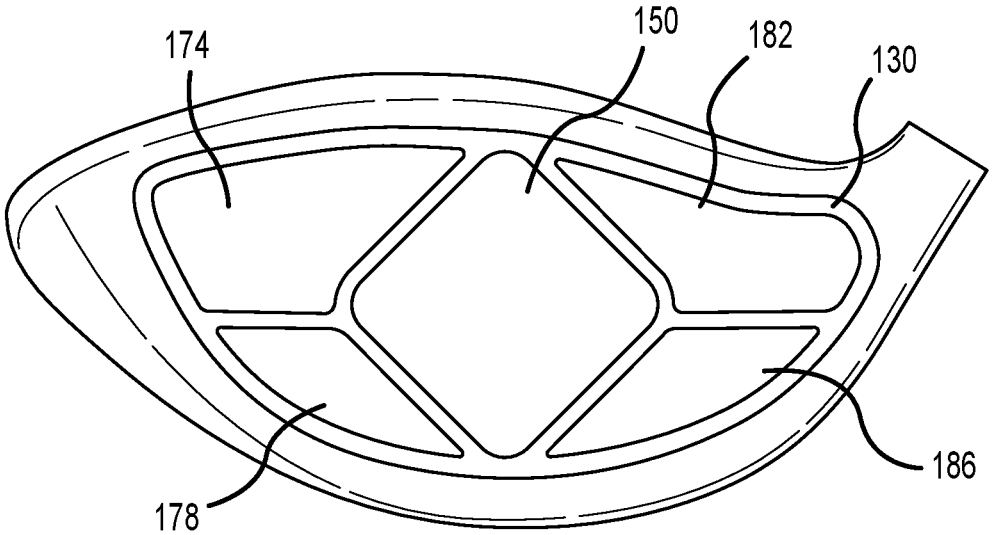
FIG. 6 illustrates a front view of a golf club head faceplate subdivided into different faceplate regions.

In other embodiments, as illustrated in FIG. 6, the faceplate 130 can further comprise a high-toe region 174, a low-toe region 178, a high-heel region 182, a low-heel region 186. The lattice 140 can be positioned on the high-toe region 174, the low-toe region 178, the high-heel region 182, the low-heel region 178, or any combination thereof. The location of the lattice 140 on the faceplate 130 can affect how the faceplate 130 bends during golf ball impacts. In some embodiments, the lattice 140 can provide a faceplate 130 that has asymmetric bending to achieve different golf ball shot shapes such as draw, fade, or straight. In one example, the lattice 140 can be positioned in the high-toe region 174 and the low-heel region 186 to provide a draw bias shot shape (i.e. right-to-left ball flight). In another example, the lattice 140 can be positioned in the high-heel region 182 and low-toe region 178 to provide a fade bias shot shape (i.e. left-to-right ball flight).

In other embodiments, the lattice 140 can be positioned on an exterior surface of the club head 100 or an interior surface of the club head 100 located adjacent the closed/interior volume. More specifically, the lattice 140 can be positioned on the crown 114, the sole 118, the toe 126, the heel 122, or any combination thereof. In other embodiments still, the lattice 140 can be positioned in the faceplate 130 and at least one of the crown 114, the sole 118, the toe 126, or the heel 122. In other embodiments, a portion of the crown 114 or sole 118 can be formed as an insert that can be attached to the club head 100, where the lattice 140 is formed on the insert. In other embodiments still, the club head 100 can be integrally formed as one component or piece, where the lattice 140 can be integrally formed along with the club head 100 on at least one of the crown 114, the sole 118, the toe 126, or the heel 122. The lattice 140 positioned in at least one of the crown 114 or the sole 118 can minimize the stress concentrations and move the largest stress concentrations away from the thinnest portions of the crown 114 or sole 118.

The lattice 140 can comprise a percentage of a surface area of the back face. In some embodiments, the lattice 140 can comprise greater than 40%, greater than 45%, greater than 50%, greater than 55%, greater than 60%, greater than 65%, greater than 70%, or greater than 75% of the back face surface area. In other embodiments, the lattice 140 can comprise 10% to 100% of the back face surface area. In some embodiments, the lattice 140 can comprise 10% to 95%, 10% to 90%, 10% to 85%, 10% to 80%, 10% to 75%, 10% to 70%, 10% to 65%, 10% to 60%, 10% to 55%, or 10% to 50% of the back face surface area. In some embodiments, the lattice 140 can comprise 10% to 25%, 25% to 40%, 40% to 55%, 55% to 70%, 70% to 85%, or 85% to 100% of the back face surface area. For example, the lattice 140 can comprise 10%, 20%, 30%, 40%, 50%, 55%, 60%, 65%, 70%, 75%, 80%, 85%, 90%, 95%, or 100% of the back face surface area.

The lattice 140 can comprise at least one repeating pattern. In some embodiments, the lattice 140 can comprise a plurality of repeating patterns. For example, the lattice 140 can comprise one, two, three, four, or five repeating patterns. In other embodiments, the at least one repeating pattern can be a radial pattern, where the pattern repeats in a direction of a radius (i.e. from the faceplate center to the faceplate perimeter).

The number of flexure shapes of the lattice 140 can influence how the lattice 140 stores energy in the faceplate. In some embodiments, the number of flexure shapes can increase, decrease, or remain constant towards the center region 150, the toe region 158, the heel region 162, the bottom region 166, the top region 170, the high-toe region 174, the low-toe region 178, the high-heel region 182, or the low-heel region 178. For example, the number of flexure shapes can decrease towards the toe region 158 of the faceplate 130. In another example, the number of flexure shapes can decrease towards the bottom region 166 of the faceplate 130. In other example, the number of flexure shapes can decrease towards the heel region 162 of the faceplate 130. In another example, the number of flexure shapes can decrease towards the top region 170 of the faceplate 130.

The size (i.e. volume) of the flexure shapes of the lattice 140 can influence how the lattice 140 stores energy in the faceplate. In some embodiments, the size of the flexure shapes can increase, decrease, or remain constant towards the center region 150, the toe region 158, the heel region 162, the bottom region 166, the top region 170, the high-toe region 174, the low-toe region 178, the high-heel region 182, or the low-heel region 178. For example, the size of the flexure shapes can be greater at the toe region 158 than the heel region 162 to facilitate in toe bending of the faceplate 130. In another example, the size of the flexure shapes can be greater at the bottom region 166 than the top region 170 to facilitate in sole bending of the faceplate 130. In another example, the size of the flexure shapes can be greater at heel region 162 than the toe region 158 to facilitate in heel bending of the faceplate 130. In another example, the size of the flexure shapes can be greater at the top region 170 than the bottom region 166 to facilitate in crown bending of the faceplate 130.

The number of flexure shapes can correspond with the size of the flexure shapes. The number of flexure shapes can have an inverse relationship with the size of the flexure shapes. As the size of the flexure shapes increases, the number of flexure shapes decreases. Stated another way, as the size of the flexure shapes decreases, the number of flexure shapes increases. The size and the number of flexure shapes along with the positioned of the flexure shapes on the faceplate 130 can further enhance a desirable golf ball shot shape such as draw, fade, or straight.

Figure 7:
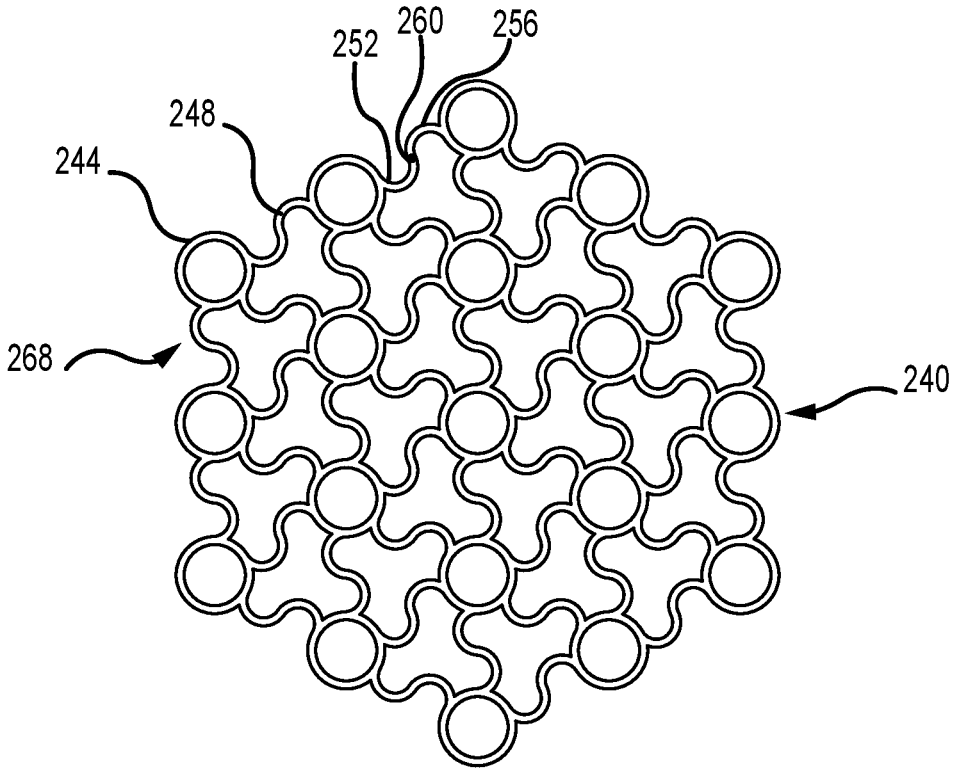
FIG. 7 illustrates a portion of a faceplate lattice according to an embodiment.
Figure 8:
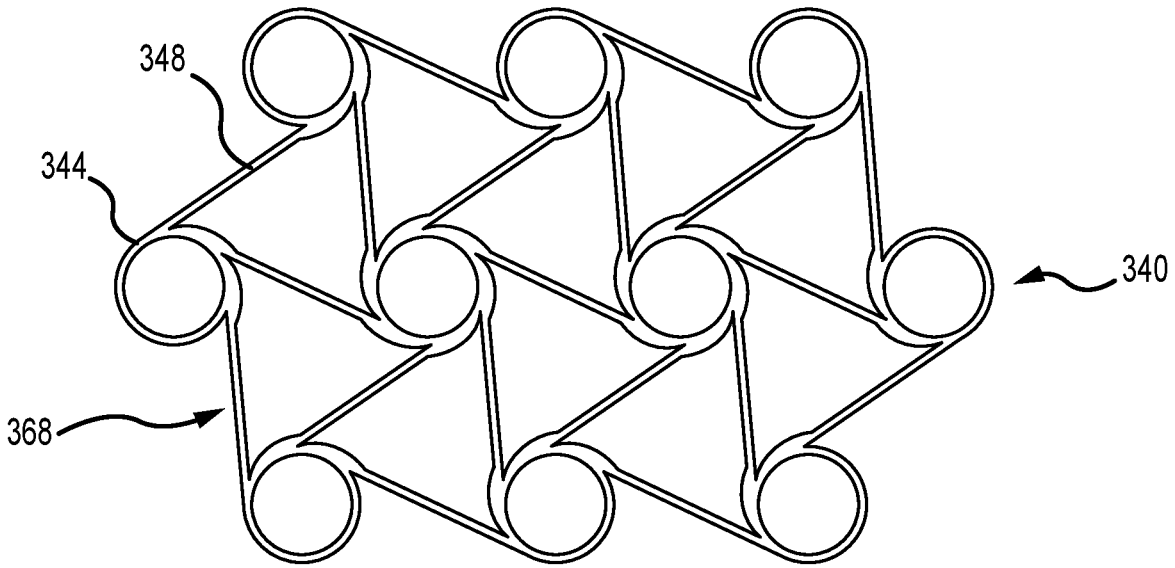
FIG. 8 illustrates a portion of a faceplate lattice according to an embodiment.
Figure 9:
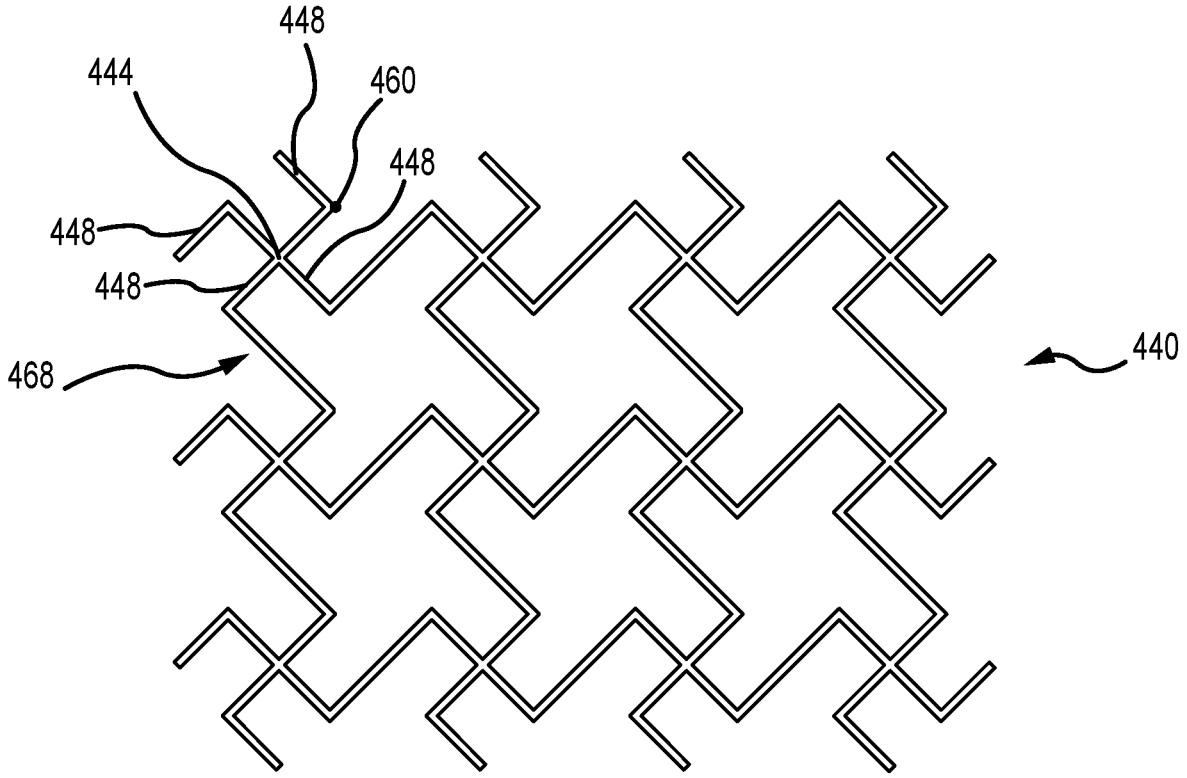
FIG. 9 illustrates a portion of a faceplate lattice according to an embodiment.

The plurality of flexure lattice 140 shapes facilitate in faceplate bending. The flexure shapes of the lattice 140 can comprise a reentrant (i.e. shape pointing inward), concave, or non-convex shape. As illustrated in FIGS. 7-9, the flexure shapes of the lattice 140 can comprise a series of interconnected grooves. The series of interconnected grooves can comprise a base groove, and a plurality of ligament grooves connected to the base groove. The series of interconnected grooves can comprise a repeating pattern of base grooves, and a repeating pattern of ligament grooves, where the repeating pattern of base grooves and ligament grooves are interconnected to from the flexure shapes. The flexure shapes can be formed from a portion of the base groove and the ligament grooves, where portions of the flexure shape are either concave or convex relative to a center of the flexure shape. As described in more detail below, the series of interconnected grooves can be arranged in a sunburst pattern, a chiral pattern, or a windmill pattern.

In some embodiments, as illustrated in FIGS. 10-14, the flexure shapes of the lattice 140 can be formed from a plurality of land portions, where the plurality of land portions form a plurality of flexure shape recesses. The flexure shape recess can comprise at least two vertices that define acute interior angles and at least one vertex defining a reflex angle on a perimeter of the flexure shape recess. The at least one reflex angle vertex is positioned between the at least two acute interior angle vertices. The at least one reflex angle vertex does not define an acute interior angle. The acute interior angle can define an angle less than 90 degrees, and the reflex angle can define an angle greater than 180 degrees and less than 360 degrees. The at least one reflex angle vertex of the flexure shape recess can define the reentrant, concave, or non-convex shape of the flexure shape recess. As described in more detail below, the flexure shape recesses formed from the land portions can comprise a plurality of Evan, arrowhead, four-pointed star, six-pointed star, or three-pointed star flexure shape recesses.

Figure 15:
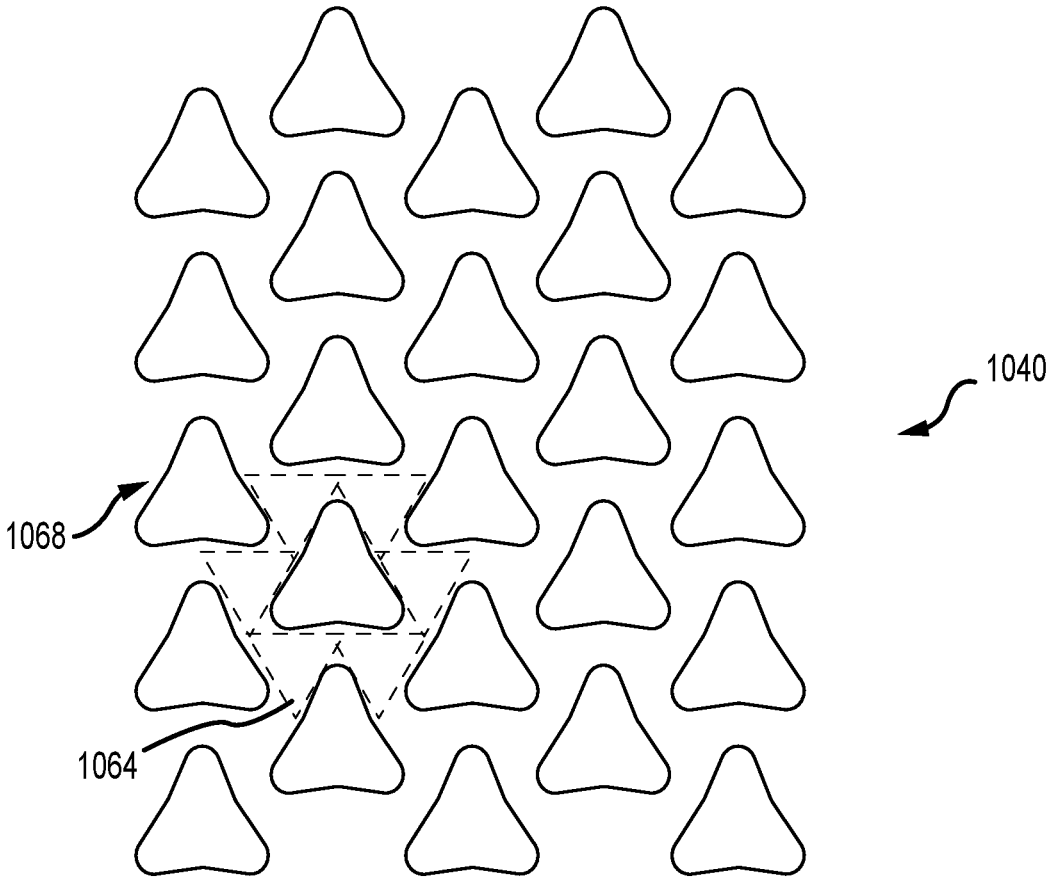
FIG. 15 illustrates a portion of a faceplate lattice according to an embodiment.
Figure 16:
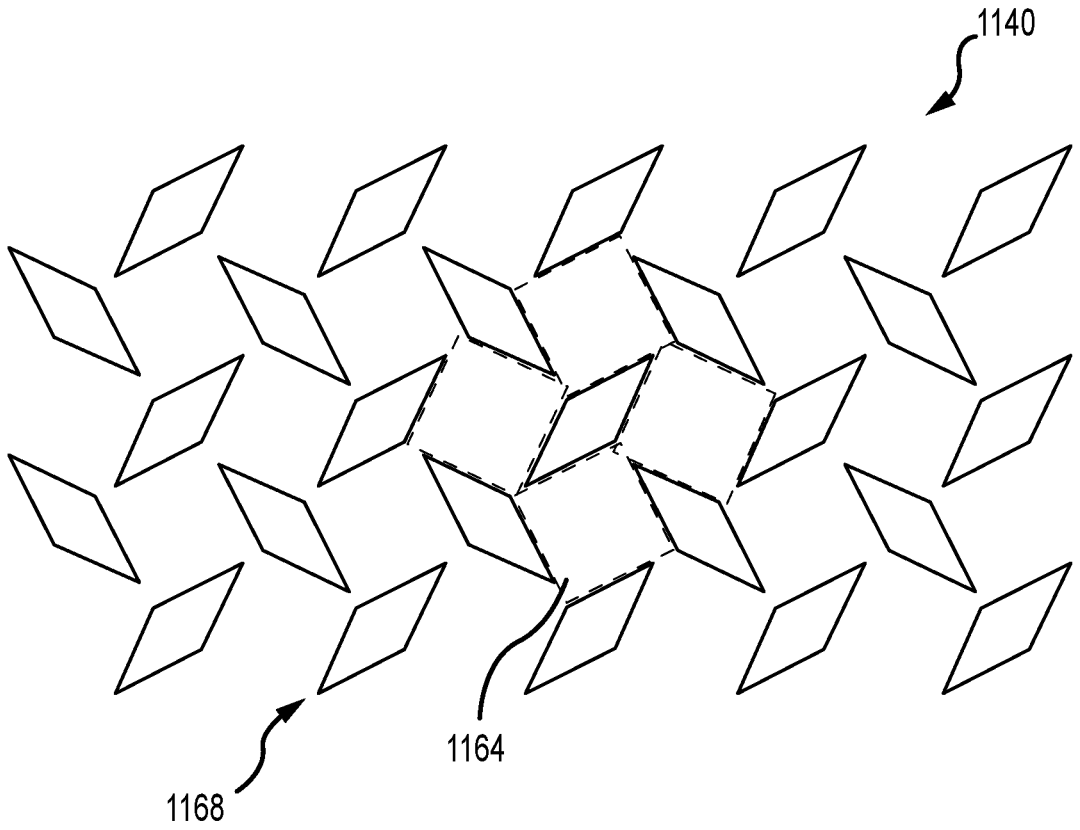
FIG. 16 illustrates a portion of a faceplate lattice according to an embodiment.
Figure 17:
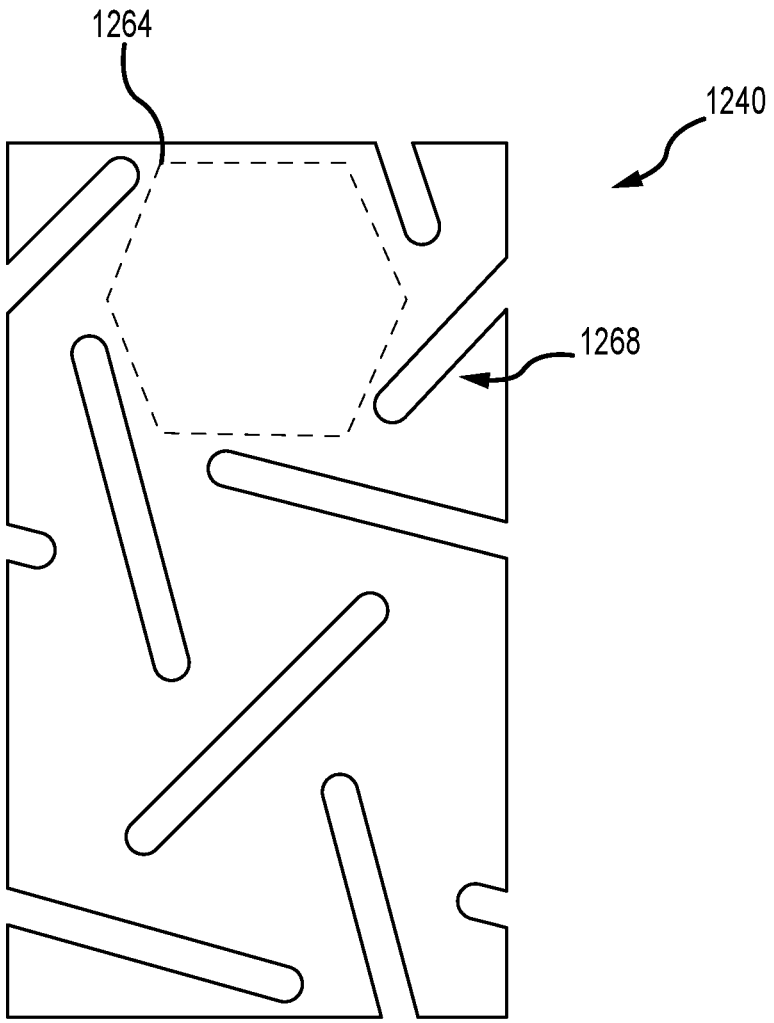
FIG. 17 illustrates a portion of a faceplate lattice according to an embodiment.

In other embodiments, as illustrated in FIGS. 15-17, the flexure shapes can be formed from a plurality of land portions, where the plurality of land portions form a plurality of flexure shape recesses. In these embodiments, the land portions can comprise a geometric shape between adjacent flexure shape recesses. The geometric shape of the land portions can comprise a triangle, a square, a rectangle, a rhombus, a parallelogram, or a hexagon. The plurality of land portions can comprise a plurality of interconnected shapes, where each land portion geometric shape can define a portion of one or more flexure shape recesses. As described in more detailed below, the flexure shapes recesses form from the land portions with geometric shapes can comprise a plurality of triad, diamond, or slot flexure shape recesses.

Further, in some embodiments, the faceplate lattice 140 can exhibit auxetic behavior. Auxetic behavior can be define as structures that have a near zero or negative Poisson's ratio. In other words, as the auxetic structure is stretched or a tension force is applied, the structure tends to become thicker (as opposed to thinner) or expand in a direction perpendicular to the applied force. In contrast, materials with a positive Poisson's ratio that are not near zero, contract in a direction perpendicular to the applied force. Auxetic structures are advantageous for club head faceplates because the expansive property of auxetic structures when stretched in tension increases the flexibility of the faceplate and the faceplate energy storage. Increasing the faceplate energy storage results in increases in ball speed during golf ball impacts.

Based on finite element simulations measuring the internal energy of the faceplate 130 during golf ball impacts, the faceplate 130 comprising a lattice 140 increases the internal energy storage by 10% to 20% compared to a faceplate devoid of the lattice 140. In some embodiments, the internal energy storage can increase by 10% to 15%, or 15% to 20%. This increase in internal energy storage equates to approximately a 1.0 to 3.0 mph increase in ball speed compared to a faceplate devoid of the lattice 140. In some embodiments, the ball speed increases by 1.0 to 2.0 mph, or 2.0 to 3.0 mph. In some embodiments, the ball speed increases by 1.0 to 1.5 mph, 1.5 to 2.0 mph, 2.0 to 2.5 mph, or 2.5 to 3.0 mph. This increase in ball speed equates to approximately a 5 to 15 yard increase in ball distance compared to a faceplate devoid of the lattice 140. In some embodiments, the ball distance increases by 5 to 10 yards, or 10 to 15 yards. In some embodiments, the ball distance increases by 5 to 7 yards, 7 to 9 yards, 9 to 11 yards, 11 to 13 yards, or 13 to 15 yards. The advantages of the faceplate 130 comprising the lattice 140 are described in more detail below.

Based on coefficient of restitution (COR) faceplate tests measuring the faceplate 130 during golf ball impacts, the faceplate 130 comprising the lattice 140 increases the COR by 2% to 10% compared to a faceplate devoid of the lattice 140. In some embodiments, the COR can increase by 2% to 5%, or 5% to 10% compared to a faceplate devoid of the lattice 140. For example, the COR of the faceplate 130 having the lattice 140 can increase by 2%, 3%, 4%, 5%, 6%, 7%, 8%, 9%, or 10% compared to a faceplate devoid of the lattice 140.

The dimensions of the lattice 140 can influence how the lattice stores energy in the faceplate. For example, the lattice 140 can comprise a depth measured as a distance from the back face 138 to a bottom surface of the lattice 140 in a direction perpendicular to the back face 138. The lattice 140 depth can range from 0.025 inch to 0.075 inch. The lattice 140 depth can range from 0.025 inch to 0.05 inch, or 0.05 inch to 0.075 inch. For example, the lattice 140 depth can be 0.025, 0.03, 0.035, 0.04, 0.045, 0.05, 0.055, 0.06, 0.065, 0.07, or inch. In one example, the lattice 140 depth can be 0.05 inch.

The dimensions of the faceplate 130 can influence how the lattice stores energy in the faceplate. For example, the faceplate 130 comprises a thickness measured from the strike face 134 to the back face 138 in a direction perpendicular to the strike face 134. The faceplate 130 thickness varies from the faceplate center 132 to the faceplate perimeter 136. The faceplate thickness can facilitate in reducing the weight of the faceplate and allow the weight to be moved to other portions of the club head (e.g. sole) to facilitate in center of gravity location or moment of inertia.

A thicker faceplate 130 can minimize the energy storage capabilities of the lattice 140 by restricting the flexing of the faceplate 130. A thinner faceplate 130 can increase the energy storage capabilities of the lattice 140 by allowing the faceplate 130 to freely flex. For example, the faceplate thickness near the faceplate center can range from 0.10 inch to 0.25 inch. In some embodiments, the faceplate thickness near the faceplate center can range from 0.10 inch to 0.175 inch, or 0.175 inch to 0.25 inch. In other embodiments, the faceplate thickness near the faceplate center can range from 0.10 inch to 0.15 inch, 0.15 inch to 0.20 inch, or 0.20 inch to 0.25 inch. For example, the faceplate thickness near the faceplate center can be 0.10, 0.11, 0.12, 0.13, 0.14, 0.15, 0.16, 0.17, 0.18, 0.19, 0.20, 0.21, 0.22, 0.23, 0.24, or 0.25 inch. In another example, the faceplate thickness near the faceplate center can be 0.20 inch.

In another example, the faceplate thickness near the faceplate perimeter can range from 0.60 inch to 0.14 inch. In some embodiments, the faceplate thickness near the faceplate perimeter can range from 0.60 inch to 0.10 inch, or 0.10 inch to 0.14 inch. In some embodiments, the faceplate thickness near the faceplate perimeter can range from 0.60 inch to 0.08 inch, 0.08 inch to 0.10 inch, 0.10 inch to 0.12 inch, or 0.12 inch to 0.14 inch. For example, the faceplate thickness near the faceplate perimeter can be 0.06, 0.07, 0.08, 0.09, 0.10, 0.11, 0.12, 0.13, or 0.14 inch. In another example, the faceplate thickness near the faceplate perimeter can be 0.09 inch.

Lattice with Series of Interconnected Grooves

As discussed above, the lattice can comprise a plurality of flexure shapes. These flexure shapes can further comprise a series of interconnected grooves. The series of interconnected grooves can comprise a base groove and a plurality of ligament grooves extending outward from the base groove. The plurality of ligament grooves can be connected or integral with the base groove. The plurality of ligament grooves can be equally spaced along the base groove or unequally spaced. The series of interconnected grooves can comprise a repeating pattern of base grooves, and a repeating pattern of ligament grooves, where the repeating pattern of base grooves and ligament grooves are interconnected to from the flexure shapes. The flexure shapes can be formed from a portion of the base groove and the ligament grooves, where portions of the flexure shape are either concave or convex relative to a center of the flexure shape. The lattice having the flexure shapes formed from the series of interconnected grooves facilitates in storing greater energy in the faceplate to allow for greater ball speed during golf ball impacts. Described below are three examples of lattices comprising interconnected base grooves and ligament grooves.

Sunburst Grooves

In one example, as illustrated in FIG. 7, the faceplate 130 can comprise a lattice 240. The lattice 240 can be similar to lattice 140 as described above, but can differ in size, shape, or dimensions. The lattice 240 can comprise a plurality of sunburst grooves. Stated another way, the lattice 240 can comprise a plurality of grooves arranged in a sunburst pattern. Each sunburst groove can comprise a base groove 244, and six ligament grooves 248 extending from the base groove 244. The base groove 244 can be circular, and the ligament grooves 248 can be curved. The ligament grooves 248 can extend non-linearly outward or away from the base groove 244.

The ligament grooves 248 can comprise a first curve 252, a second curve 256, and an inflection point 260 positioned between the first curve 252 and the second curve 256. The position of the inflection point 260 indicates the change in direction of the ligament groove 248 curvature. In some embodiments, the first curve 252 and the second curve 256 of the ligament groove 248 can comprise similar widths. In other embodiments, the first curve 252 and the second curve 256 of the ligament groove 248 can comprise different widths.

The first curve 252 and the second curve 256 can comprise an outer radius. The outer radius of the first curve 252 and the second curve 256 can be similar or different. The outer radius of the first curve 252 and the second curve 256 can range from 0.08 to 0.16 inch. In some embodiments, the outer radius of the first curve 252 and the second curve 256 can range from 0.08 to 0.12 inch, or 0.12 to 0.16 inch. In some embodiments, the outer radius of the first curve 252 and the second curve 256 can range from 0.08 to 0.1 inch, 0.1 to 0.12 inch, 0.12 to 0.14 inch, or 0.14 to 0.16 inch. For example, the outer radius of the first curve 252 and the second curve 256 can be 0.05, 0.06, 0.07, 0.08, 0.09, 0.1, 0.11, 0.12, 0.13, 0.14, or 0.15 inch.

The first curve 252 and the second curve 256 can comprise an inner radius. The inner radius is less than the outer radius. Stated another way, the outer radius is greater than the inner radius. The inner radius of the first curve 252 and the second curve 256 can be similar or different. The inner radius of the first curve 252 and the second curve 256 can range from 0.03 to 0.09 inch. In some embodiments, the inner radius of the first curve 252 and the second curve 256 can range from 0.03 to 0.06 inch, or 0.06 to 0.09 inch. For example, the inner radius of the first curve 252 and the second curve 256 can be 0.03, 0.04, 0.05, 0.06, 0.07, 0.075 0.08, or 0.09 inch.

As illustrated in FIG. 7, at least three sunburst grooves form a flexure shape 268. The flexure shape 268 can comprise a portion of at least three base grooves 244 and at least three ligament grooves 248. A portion of the circular base groove 244 and the curved ligament grooves 248 form the reentrant shape of the flexure shape 268, where portions of the flexure shape 268 are concave or convex relative to a center of the flexure shape 268. Further, adjacent flexure shapes 268 can share at least one ligament groove 248, where the shared ligament groove 248 forms a portion of two flexure shapes 268.

As illustrated in FIG. 7, the lattice 240 can comprise a repeating pattern of sunburst grooves, where the flexure shapes 268 are interspersed with circular shapes (i.e. base grooves 244). Stated another way, the lattice 240 can comprise a first repeating pattern of flexure shapes 268, and a second repeating pattern of circular shapes, where the first repeating pattern is interspersed in the second repeating pattern. Further, stated another way, the lattice 240 can comprise a repeating pattern of interconnected flexure shapes 268.

The dimensions of the lattice 240 can influence how the lattice stores energy in the faceplate 130. For example, the base groove 244 can comprise an outer diameter. The outer diameter of the base groove 244 can range from 0.1 to 0.3 inch. In some embodiments, the outer diameter of the base groove 244 can range from 0.1 to 0.2 inch, or 0.2 to 0.3 inch. For example, the outer diameter of the base groove 244 can be 0.10, 0.11, 0.12, 0.13, 0.14, 0.15, 0.16, 0.17, 0.18, 0.19, 0.2, 0.25, or 0.30 inch.

The base groove 244 can comprise an inner diameter. The inner diameter of the base groove 244 can range from 0.05 to 0.2 inch. In some embodiments, the inner diameter of the base groove 244 can range from 0.05 to 0.125 inch, or 0.125 to 0.2 inch. For example, the inner diameter of the base groove 244 can be 0.05, 0.1, 0.11, 0.12, 0.13, 0.14, 0.15, 0.16, 0.17, 0.18, 0.19, or 0.2 inch.

Chiral Grooves

In another example, as illustrated in FIG. 8, the faceplate 130 can comprise a lattice 340. The lattice 340 can be similar to lattice 140 as described above, but can differ in size, shape, or dimensions. The lattice 340 can comprise a plurality of chiral grooves. Stated another way, the lattice 340 can comprise a plurality of grooves arranged in chiral pattern. Each chiral groove can comprise a base groove 344, and six ligament grooves 348 extending from the base groove 344. Lattice 340 can be similar to lattice 240, but differ in ligament groove geometry. The base groove 344 can be circular, and the ligament grooves 348 can be linear. The ligament grooves 348 can extend linearly outward from the base groove 344, where the ligament grooves 348 can be tangent to the circular base groove 348.

As illustrated in FIG. 8, three chiral grooves form a flexure shape 368. The flexure shape 368 can comprise a portion of at least three base grooves 344 and at least three ligament grooves 348. A portion of the circular base groove 344 forms the reentrant shape of the flexure shape 368, where portions of the flexure shape 368 are concave relative to a center of the flexure shape 368. Further, adjacent flexure shapes 368 can share at least one ligament groove 348, where the shared ligament groove 348 forms a portion of two flexure shapes 368.

The dimensions of the lattice 340 can influence how the lattice stores energy in the faceplate 130. For example, the base groove 344 can comprise an outer diameter. The outer diameter of the base groove 344 can range from 0.1 to 0.3 inch. In some embodiments, the outer diameter of the base groove 344 can range from 0.1 to 0.2 inch, or 0.2 to 0.3 inch. For example, the outer diameter of the base groove 344 can be 0.10, 0.11, 0.12, 0.13, 0.14, 0.15, 0.16, 0.17, 0.18, 0.19, 0.2, 0.25, or 0.30 inch.

The base groove 344 can comprise an inner diameter. The inner diameter of the base groove 344 can range from 0.05 to 0.2 inch. In some embodiments, the inner diameter of the base groove 344 can range from 0.05 to 0.125 inch, or 0.125 to 0.2 inch. For example, the inner diameter of the base groove 344 can be 0.05, 0.1, 0.11, 0.12, 0.13, 0.14, 0.15, 0.16, 0.17, 0.18, 0.19, or 0.2 inch.

Windmill Grooves

In another example, as illustrated in FIG. 9, the faceplate 130 can comprise a lattice 440. The lattice 440 can be similar to lattice 140 as described above, but can differ in size, shape, or dimensions. The lattice 440 can comprise a plurality windmill grooves. Stated another way, the lattice 440 can comprise a plurality of grooves arranged in a windmill pattern. Each windmill groove can comprise four ligament grooves 448 that meet or converge at a base point 444. The ligament grooves 448 can extend away from the base point 444, where a right angle (i.e. approximately 90 degrees) forms between adjacent ligament grooves 448. Each ligament groove 448 extends away from the base point 444 to an inflection point 460, where each ligament groove 448 changes direction at the inflection point 460.

Each ligament groove 448 can comprise a first segment 452, a second segment 456, and the inflection point 460 positioned between the first segment 452 and the second segment 456. The position of the inflection point 460 indicates the change in direction of the ligament groove 448. The inflection point 460 can define a right angle (i.e. approximately 90 degrees) between the first segment 452 and the second segment 456 of the ligament groove 448. In some embodiments, the first segment 452 and the second segment 456 of the ligament groove 448 can comprise similar widths. In other embodiments, the first segment 452 and the second segment 456 of the ligament groove 448 can comprise different widths.

As illustrated in FIG. 9, four windmill grooves can form a flexure shape 468. The flexure shape 468 can comprise eight ligament grooves 448. The ligament grooves 448 form the reentrant shape of the flexure shape 468, where portions of the flexure shape 468 are concave or convex relative to a center of the flexure shape 468. Further, adjacent flexure shapes 468 can share at least two ligament grooves 448, where the shared ligament grooves 448 form a portion of two flexure shapes 468.

The dimensions of the lattice 240, 340, and 440 can influence how the lattice stores energy in the faceplate 130. For example, as illustrated in FIGS. 7 and 8, the base grooves 244 and 344 can comprise a width (hereafter "base groove width"). The base groove width can range from 0.01 inch to 0.1 inch. In some embodiments, the base groove width can range from 0.01 inch to 0.05 inch, or 0.05 inch to 0.1 inch. In some embodiments, the base groove width can range from 0.01 to 0.03 inch, 0.01 to 0.04 inch, 0.01 to 0.05 inch, 0.01 to 0.06 inch, 0.01 to 0.07 inch, 0.01 to 0.08 inch, or 0.01 to 0.09 inch. For example, the base groove width can be 0.01, 0.02, 0.03, 0.04, 0.05, 0.06, 0.07, 0.08, 0.09, or 0.1 inch.

In another example, as illustrated in FIG. 7-9, the ligament grooves 248, 348, and 448 can comprise a width (hereafter "ligament groove width"). The ligament groove width can be the same or different than the base groove width. For example, the ligament groove width can be greater than the base groove width. In another example, the ligament groove width can be less than the base groove width. In some embodiments, the base groove width can range from 0.01 inch to 0.05 inch, or 0.05 inch to 0.1 inch. In some embodiments, the ligament groove width can range from 0.01 to 0.03 inch, 0.01 to 0.04 inch, 0.01 to 0.05 inch, 0.01 to 0.06 inch, 0.01 to 0.07 inch, 0.01 to 0.08 inch, or 0.01 to 0.09 inch. For example, the ligament groove width can be 0.01, 0.02, 0.03, 0.04, 0.05, 0.06, 0.07, 0.08, 0.09, or 0.1 inch.

The dimensions, the shape, and the pattern of the lattice 240, 340, and 440 (hereafter "the lattice") formed from a series of interconnected grooves affects faceplate bending during golf ball impacts. During golf ball impacts, the flexure shapes of the lattice resemble springs storing energy through tension and torsion loads. As the golf ball impacts the faceplate, the strike face is in compression and the back face is in tension. As tension is applied to the back face, the convex and concave curves of the flexure shape ligament grooves flex and act as springs that store energy in the faceplate through linear and torsional bending (i.e. similar to a spring storing energy through tension and torsion). Storing energy through two modes of bending is advantageous over conventional club head faceplates that store energy through one mode of bending (i.e. linear bending). Storing energy though two modes of bending allows for greater ball speeds during golf ball impacts.

Further, the flexure shapes of the lattice reduce the largest stresses concentrated in a small volume of the faceplate material (i.e. impact area of the faceplate) by displacing the reduced stress over a greater volume of the faceplate material. For example, the reduced stress can be displaced over 3 to 8 base grooves or ligament grooves in a direction from near the faceplate center 132 to near the faceplate perimeter 136 in the lattice 240, 340, or 440. In some embodiments, the reduced stress can be displaced over 3 to 5, 4 to 6, 5 to 7, or 6 to 8 base grooves or ligament grooves in a direction from near the faceplate center 132 to near the faceplate perimeter 136. This reduction of stress does not occur in a faceplate devoid of the lattice 240, 340, or 440.

Lattice with Flexure Shape Recesses

Flexure Shape Recesses with Vertices

As discussed above, the lattice can comprise a plurality of flexure shapes that are formed from a plurality of land portions. The plurality of land portions can form a plurality of flexure shape recesses, where the land portions separate the flexure shape recesses. The land portions are interconnected with one another and define the portions of the club head 100 that are devoid of the flexure shape recesses. The land portions form a perimeter of the flexure shape recesses.

The land portions can comprise a width between adjacent flexure shape recesses. The land portion width can be measured from a flexure shape recess perimeter to an adjacent flexure shape recess perimeter. The land portion width can vary or remain constant between adjacent flexure shape recesses. Adjacent land portion widths can be similar or different from each other. For example, the land portion width can remain constant along one portion of the flexure shape recess perimeter, and the land portion width can vary along another portion of the flexure shape recess perimeter.

In some embodiments, the land portion width can be greater than 0.02 inch, greater than 0.05 inch, greater than 0.1 inch, greater than 0.15 inch, or greater than 0.2 inch. In some embodiments, the land portion width can range from 0.02 to 0.2 inch. In some embodiments, the land portion width can range from 0.02 to 0.1 inch, or 0.1 to 0.2 inch. In some embodiments, the land portion width can range from 0.02 to 0.05 inch, 0.05 to 0.08 inch, 0.08 to 0.11 inch, 0.11 to 0.14 inch, 0.14 to 0.17 inch, or 0.17 to 0.2 inch. For example, the land portion width can be 0.02, 0.03, 0.04, 0.05, 0.06, 0.08, 0.09, 0.1, 0.11, 0.12, 0.13, 0.14, 0.15, 0.16, 0.17, 0.18, 0.19, or 0.2 inch.

The flexure shape recess can comprise a width. The flexure shape recess width can be greater than 0.08 inch, greater than 0.1 inch, greater than 0.12 inch, greater than 0.14 inch, greater than 0.16 inch, greater than 0.18 inch, or greater than 0.2 inch. In some embodiments, the flexure shape recess width can range from 0.1 to 0.3 inch. In some embodiments, the flexure shape recess width can range from 0.1 to 0.2, or 0.2 to 0.3 inch. For example, the flexure shape recess width can be 0.1, 0.11, 0.12, 0.125, 0.13, 0.14, 0.15, 0.16, 0.17, 0.18, 0.19, 0.2, 0.25, or 0.3 inch.

The perimeter of the flexure shape recess can comprise at least two vertices that define acute interior angles, and at least one vertex defining a reflex angle. The at least one reflex angle vertex is positioned between the at least two acute interior angle vertices. The at least one reflex angle vertex does not define an acute interior angle. The acute interior angle can define an angle less than 90 degrees, and the reflex angle can define an angle greater than 180 degrees and less than 360 degrees. In some embodiments, the reflex angle can define an angle greater than 180 degrees and less than 270 degrees, or greater than 270 degrees and less 360 degrees. In other embodiments, the reflex angle can define an angle greater than 180 degrees and less than 225 degrees, greater than 225 degrees and less than 270 degrees, greater than 270 degrees and less than 315 degrees, or greater than 315 degrees and less than 360 degrees. The at least one reflex angle vertex on the flexure shape recess perimeter can define the reentrant, concave, or non-convex shape.

In some embodiments, the flexure shape recess can comprise one, two, three, four, five, or six vertices defining the reflex angle greater than 180 degrees and less than 360 degrees. The number of reflex angle vertices can correspond with the concavity of the flexure shape recess. For example, a flexure shape recess comprising two reflex angle vertices can comprise two concave portions along the flexure shape recess perimeter. In another example, a flexure shape recess comprising one reflex angle vertex can comprise one concave portion along the flexure shape recess perimeter. In another example, the flexure shape recess comprising three reflex angle vertices can comprise three concave portions along the flexure shape recess perimeter. In another example, the flexure shape recess comprising four reflex angle vertices can comprise four concave portions along the flexure shape recess perimeter. Further, in another example, the flexure shape recess comprising six reflex angle vertices can comprise six concave portions along the flexure shape recess perimeter.

The lattice comprising the flexure shape recesses formed from the plurality of land portions facilitates in storing greater energy in the faceplate to allow for greater ball speed during golf ball impacts. Described below are five examples of lattices comprising land portions and flexure shape recesses. The flexure shape recess examples described below are in reference to one orientation, but it would be appreciated that the flexure shape recesses can be oriented in several different configurations to achieve greater faceplate energy storage and greater ball speed during golf ball impacts. Further, it would be appreciated that the vertices on the flexure shape recess perimeter can be rounded or comprise a small radius to round off any sharp edges on the flexure shape recess perimeter to minimize stress concentrations in the faceplate 130.

Evan Flexure Shape Recess

Figure 10:
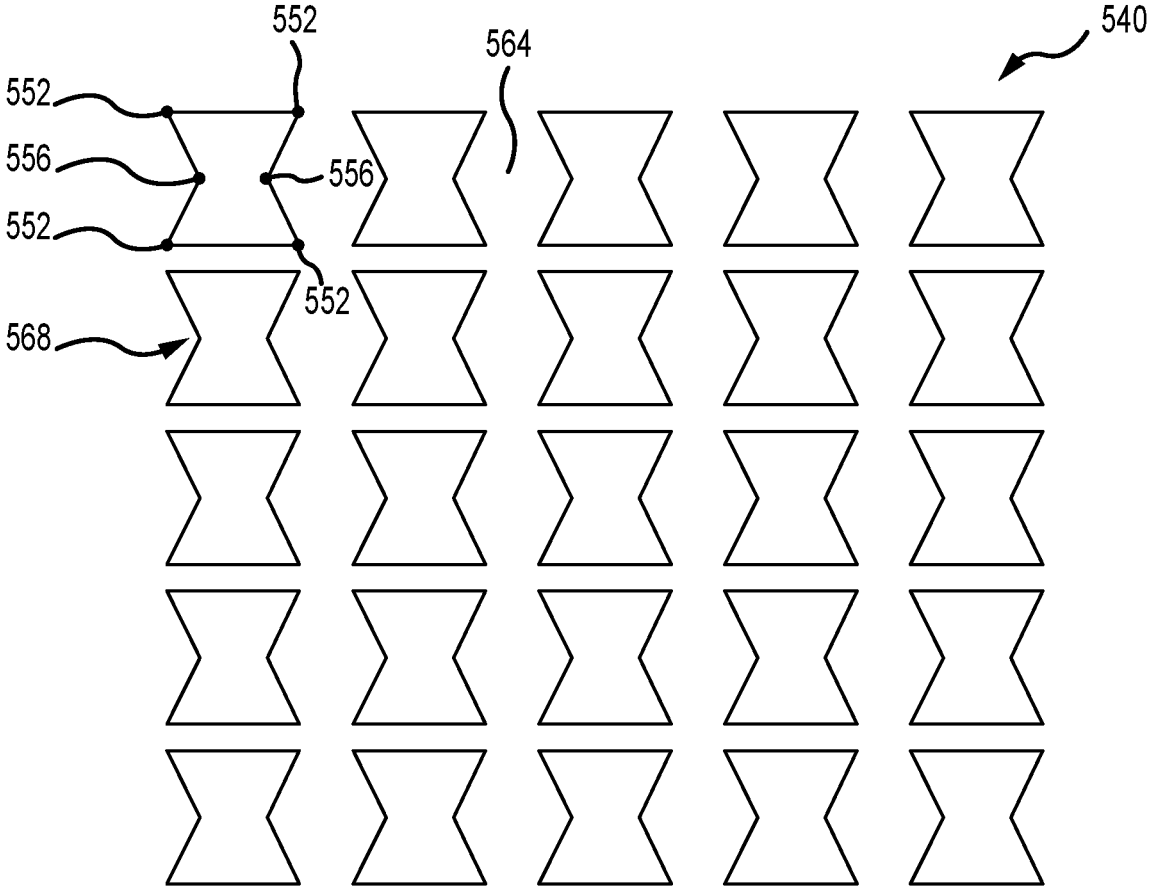
FIG. 10 illustrates a portion of a faceplate lattice according to an embodiment.

In one example, as illustrated in FIG. 10, the faceplate 130 can comprise a lattice 540. The lattice 540 can be similar to lattice 140 as described above, but can differ in size, shape, or dimensions. A plurality of land portions 564 can form a plurality of Evan flexure shape recesses 568. Each Evan flexure shape recess 568 can comprise four vertices 552 that define acute interior angles, and two vertices 556 that define reflex angles.

As illustrated in FIG. 10, the Evan flexure shape recesses 568 can comprise a bow tie shape, where a width of the Evan flexure shape recess 568 decreases from the acute interior angle vertices 552 to the reflex angle vertices 556. Stated another way, the width of the Evan flexure shape recess 568 is greater between opposite acute interior angle vertices 552 than between opposite reflex angle vertices 556. A minimum width of the Evan flexure shape recess 568 can measured across opposite reflex angle vertices 556. As described above, the width of the Evan flexure shape recess 568 can be greater than 0.08 inch, greater than 0.1 inch, greater than 0.12 inch, greater than 0.14 inch, greater than 0.16 inch, greater than 0.18 inch, or greater than 0.2 inch. In some embodiments, as described above, the width of the Evan flexure shape recess 568 can range from 0.1 to 0.3 inch. In one example, the width of the Evan flexure shape recess 568 can be 0.125 inch.

The width of the land portions 564 can correspond with the width of the Evan flexure shape recess 568. In this example, the width of the land portions 564 can vary along a portion of the perimeter of the Evan flexure shape recess 568. More specifically, the width of the land portions 564 between adjacent Evan flexure shape recesses 568 increases from the acute interior angle vertices 552 to the reflex angle vertices 556. Stated another way, the width of the land portions 564 between adjacent Evan flexure shape recesses 568 is greater at the reflex angle vertices 556 than at the acute interior angle vertices 552. Further, stated another way, the width of the land portions 564 between adjacent Evan flexure shape recesses 568 is less at the acute interior angle vertices 552 than at the reflex angle vertices 556. In this example, the width of the land portions 564 along another portion of the perimeter of the Evan flexure shape recess 568 can remain constant.

Further, as described above, the width of the land portion 564 can be greater than 0.02 inch, greater than 0.05 inch, greater than 0.1 inch, greater than 0.15 inch, or greater than 0.2 inch. In some embodiments, as described above, the width of the land portion 564 can range from 0.02 to 0.2 inch.

Arrowhead Flexure Shape Recess

Figure 11:
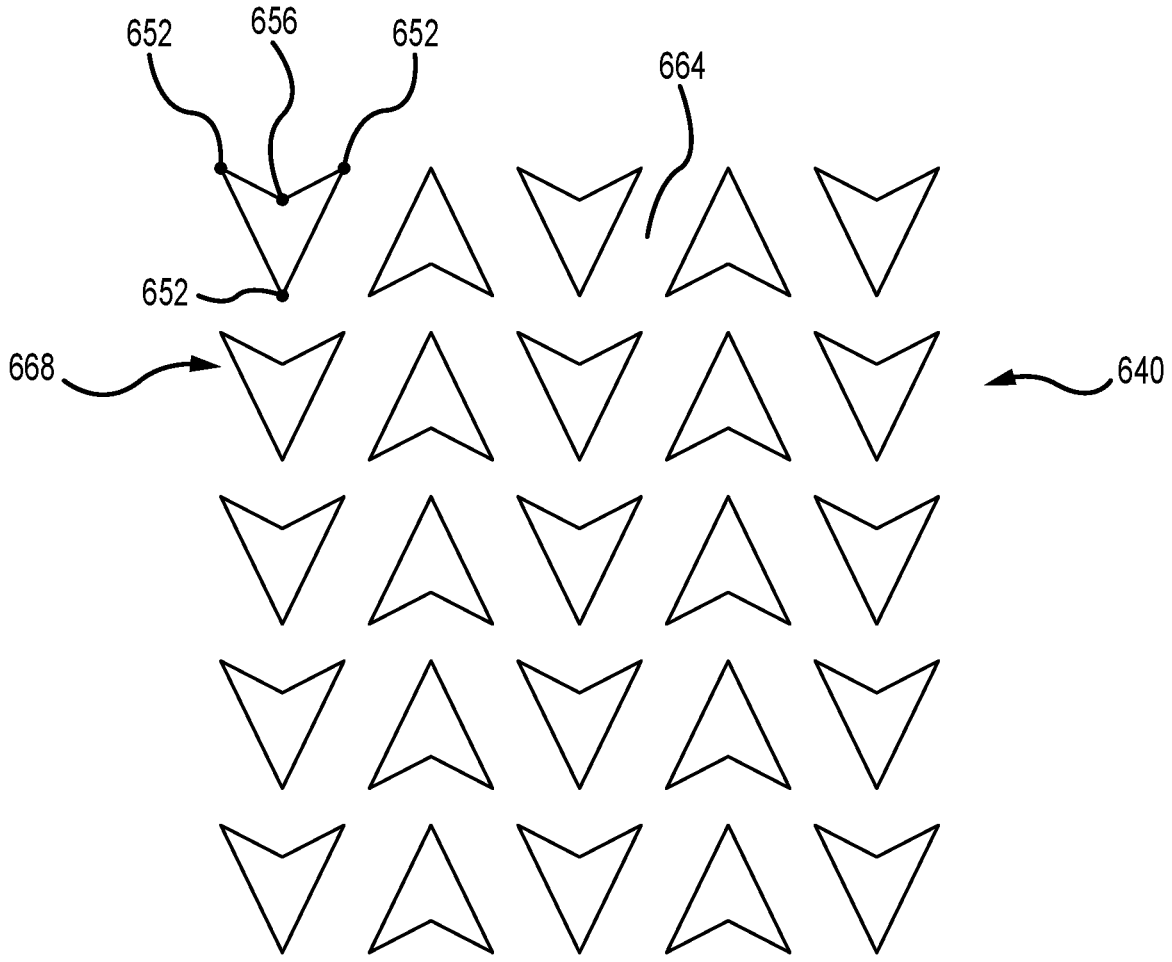
FIG. 11 illustrates a portion of a faceplate lattice according to an embodiment.

In another example, as illustrated in FIG. 11, the faceplate 130 can comprise a lattice 640. The lattice 640 can be similar to lattice 140 as described above, but can differ in size, shape, or dimensions. A plurality of land portions 664 can from a plurality of arrowhead flexure shape recesses 668. Each arrowhead flexure shape recess 668 can comprise three vertices 652 that define acute interior angles, and one vertex 656 that defines a reflex angle.

As illustrated in FIG. 11, the arrowhead flexure shape recess 668 can comprise a substantially triangular shape or arrowhead shape. A minimum width of the arrowhead flexure shape recess 668 can be measured between the reflex angle vertex 656 and an acute interior angle vertex 652 directly opposite the reflex angle vertex 656 (i.e. an acute interior angle vertex 652 that is not adjacent the reflex angle vertex 656). As described above, the width of the arrowhead flexure shape recess 668 can be greater than 0.08 inch, greater than 0.1 inch, greater than 0.12 inch, greater than 0.14 inch, greater than 0.16 inch, greater than 0.18 inch, or greater than 0.2 inch. In some embodiments, as described above, the width of the arrowhead flexure shape recess 668 can range from 0.1 to 0.3 inch. In one example, the width of the arrowhead flexure shape recess 668 can be 0.125 inch.

The width of land portions 664 can correspond with the width of the arrowhead flexure shape recess 668. In this example, the width of the land portions 664 can remain constant along a portion of the perimeter of the arrowhead flexure shape recess 668, and the width of the land portions 664 can vary along another portion of the perimeter of the arrowhead flexure shape recess 668.

Further, as described above, the width of the land portion 664 can be greater than 0.02 inch, greater than 0.05 inch, greater than 0.1 inch, greater than 0.15 inch, or greater than 0.2 inch. In some embodiments, as described above, the width of the land portion 664 can range from 0.02 to 0.2 inch.

Four-Pointed Star Flexure Shape Recess

Figure 12:
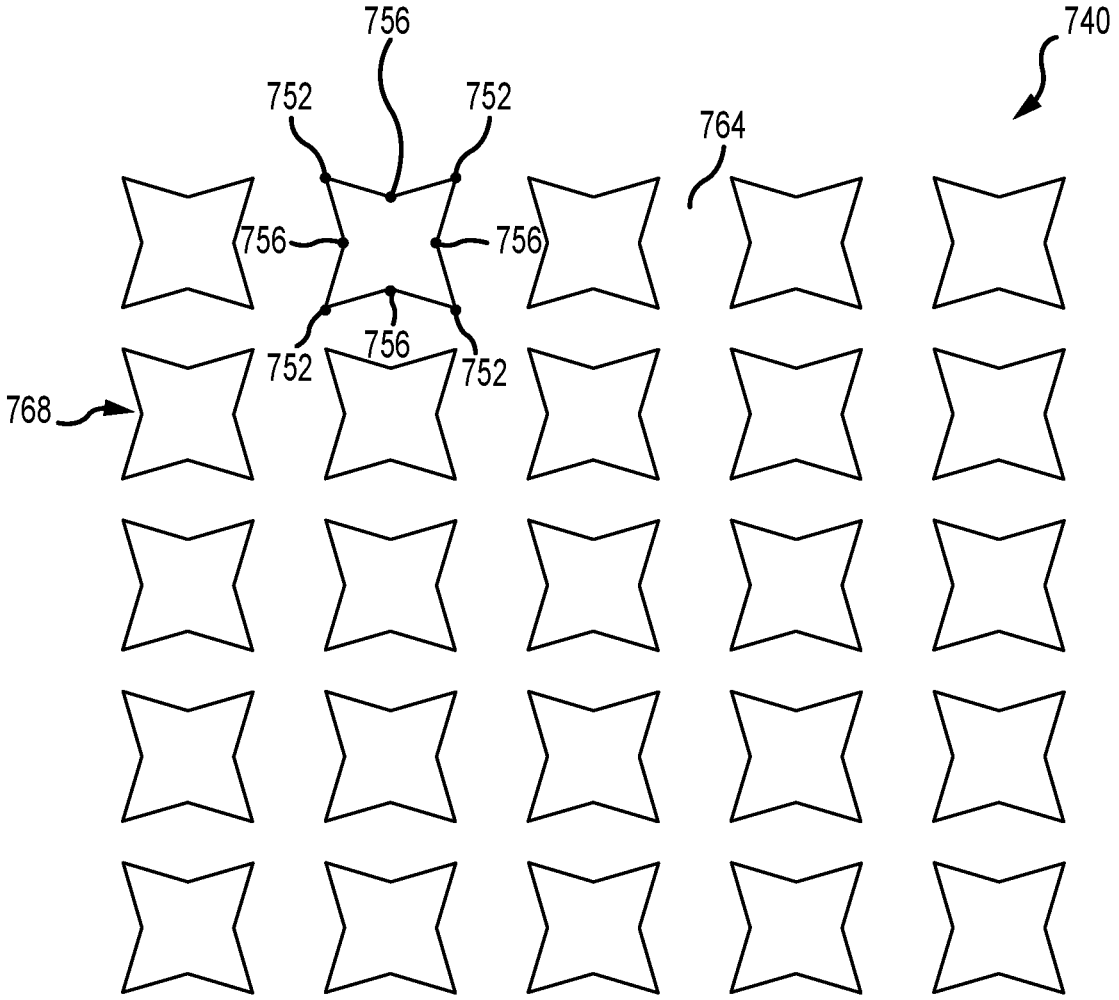
FIG. 12 illustrates a portion of a faceplate lattice according to an embodiment.

In another example, as illustrated in FIG. 12, the faceplate 130 can comprise a lattice 740. The lattice 740 can be similar to lattice 140 as described above, but can differ in size, shape, or dimensions. A plurality of land portions 764 can form a plurality of four-pointed star flexure shape recesses 768. Each four-pointed star flexure shape recess 768 can comprise four vertices 752 that define acute interior angles, and four vertices 756 that define reflex angles.

As illustrated in FIG. 12, the four-pointed star flexure shape recess 768 can comprise a star shape or a concave square shape. A minimum width of the four-pointed star flexure shape recess 768 can be measured between opposite reflex angle vertices 756. A maximum width of the four-pointed star flexure shape recess 768 can be measured between opposite acute interior angle vertices 752 (i.e. acute interior angle vertices 752 having the recess or void between them). As described above, the width of the four-pointed flexure shape recess 768 can be greater than 0.08 inch, greater than 0.1 inch, greater than 0.12 inch, greater than 0.14 inch, greater than 0.16 inch, greater than 0.18 inch, or greater than 0.2 inch. In some embodiments, as described above, the width of the four-pointed flexure shape recess 768 can range from 0.1 to 0.3 inch. In one example, the width of the four-pointed flexure shape recess 768 can be 0.125 inch.

The width of the land portions 764 can correspond with the width of the four-pointed star flexure shape recess 768. In this example, the width of the land portions 764 can vary along a portion of the perimeter of the four-pointed star flexure shape recess 768. More specifically, the width of the land portions 764 between adjacent four-pointed star flexure shape recesses 768 increases from the acute interior angle vertices 752 to the reflex angle vertices 756. Stated another way, the width of the land portions 764 is greater at the reflex angle vertices 756 than at the acute interior angle vertices 752. Further, stated another way, the width of the land portions 764 is less at the acute interior angle vertices 752 than at the reflex angle vertices 756.

Further, as described above, the width of the land portion 764 can be greater than 0.02 inch, greater than 0.05 inch, greater than 0.1 inch, greater than 0.15 inch, or greater than 0.2 inch. In some embodiments, as described above, the width of the land portion 764 can range from 0.02 to 0.2 inch.

Six-Pointed Star Flexure Shape Recess

Figure 13:
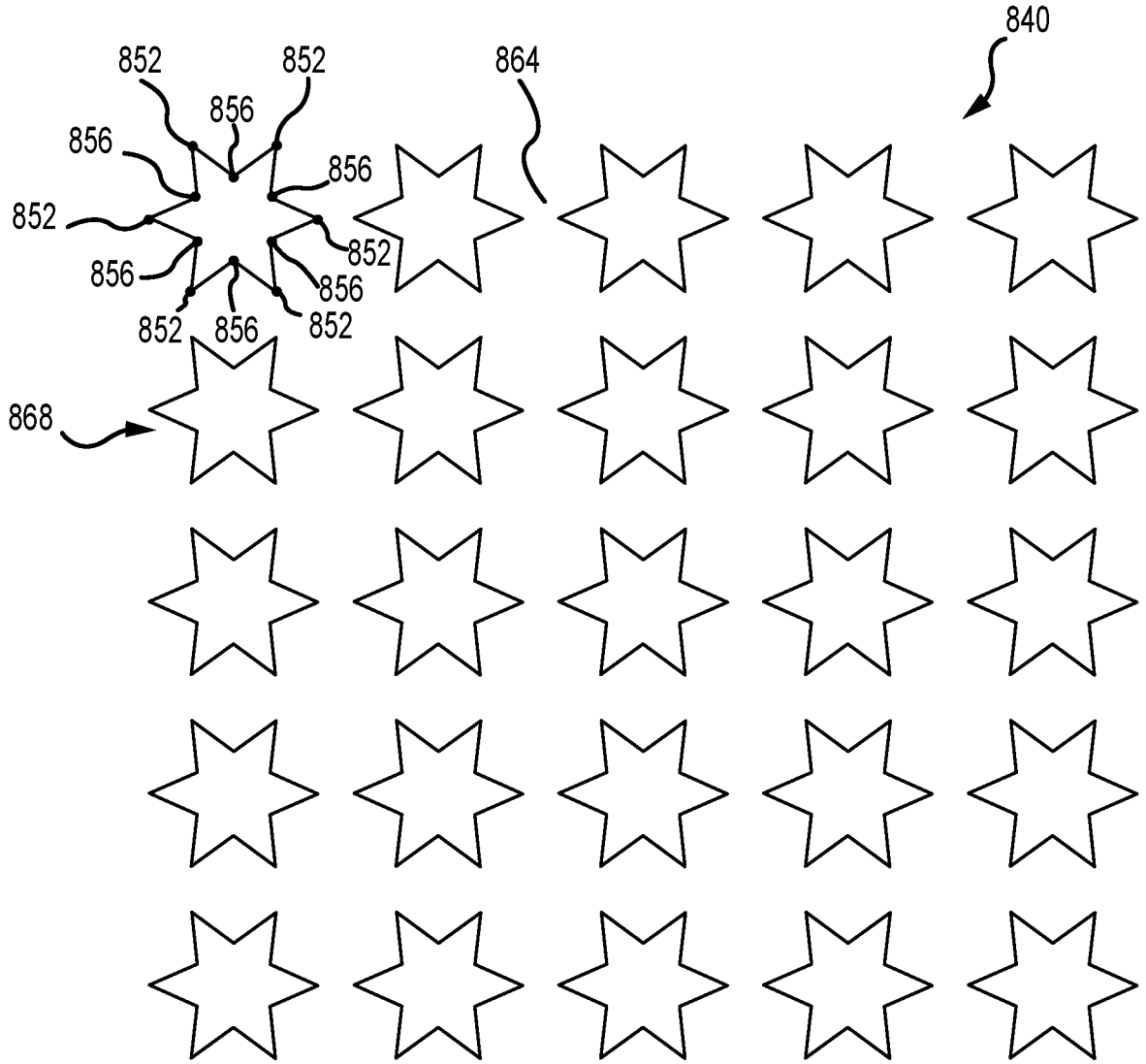
FIG. 13 illustrates a portion of a faceplate lattice according to an embodiment.

In another example, as illustrated in FIG. 13, the faceplate 130 can comprise a lattice 840. The lattice 840 can be similar to lattice 140 as described above, but can differ in size, shape, or dimensions. A plurality of land portions 864 can form a plurality of six-pointed star flexure shape recesses 868. Each six-pointed star flexure shape recess 768 can comprise six vertices 852 that define acute interior angles, and six vertices 856 that define reflex angles.

As illustrated in FIG. 13, the six-pointed star flexure shape recess 868 can comprise a star shape. A minimum width of the six-pointed star flexure shape recess 868 can be measured between opposite reflex angle vertices 856 (i.e. reflex angle vertices 856 having the recess or void between them). A maximum width of the six-pointed star flexure shape recess 868 can be measured between opposite acute interior angle vertices 852 (i.e. acute interior angle vertices 852 having the recess or void between them). As described above, the width of the six-pointed star flexure shape recess 868 can be greater than 0.08 inch, greater than 0.1 inch, greater than 0.12 inch, greater than 0.14 inch, greater than 0.16 inch, greater than 0.18 inch, or greater than 0.2 inch. In some embodiments, as described above, the width of the six-pointed star flexure shape recess 868 can range from 0.1 to 0.3 inch. In one example, the width of the six-pointed star flexure shape recess 868 can be 0.125 inch.

The width of the land portions 864 can correspond with the width of the six-pointed star flexure shape recess 868. In this example, the width of the land portions 864 can vary along a portion of the perimeter of the six-pointed star flexure shape recess 868. More specifically, the width of the land portions 864 between adjacent six-pointed star flexure shape recesses 868 increases from the acute interior angle vertices 852 to the reflex angle vertices 856. Stated another way, the width of the land portions 864 between adjacent six-pointed star flexure shape recesses 868 is greater at the reflex angle vertices 856 than at the acute interior angle vertices 852. Further, stated another way, the width of the land portions 864 between adjacent six-pointed star flexure shape recesses 868 is less at the acute interior angle vertices 852 than at the reflex angle vertices 856.

Further, as described above, the width of the land portion 864 can be greater than 0.02 inch, greater than 0.05 inch, greater than 0.1 inch, greater than 0.15 inch, or greater than 0.2 inch. In some embodiments, as described above, the width of the land portion 864 can range from 0.02 to 0.2 inch.

Three-Pointed Star Flexure Shape Recess

Figure 14:
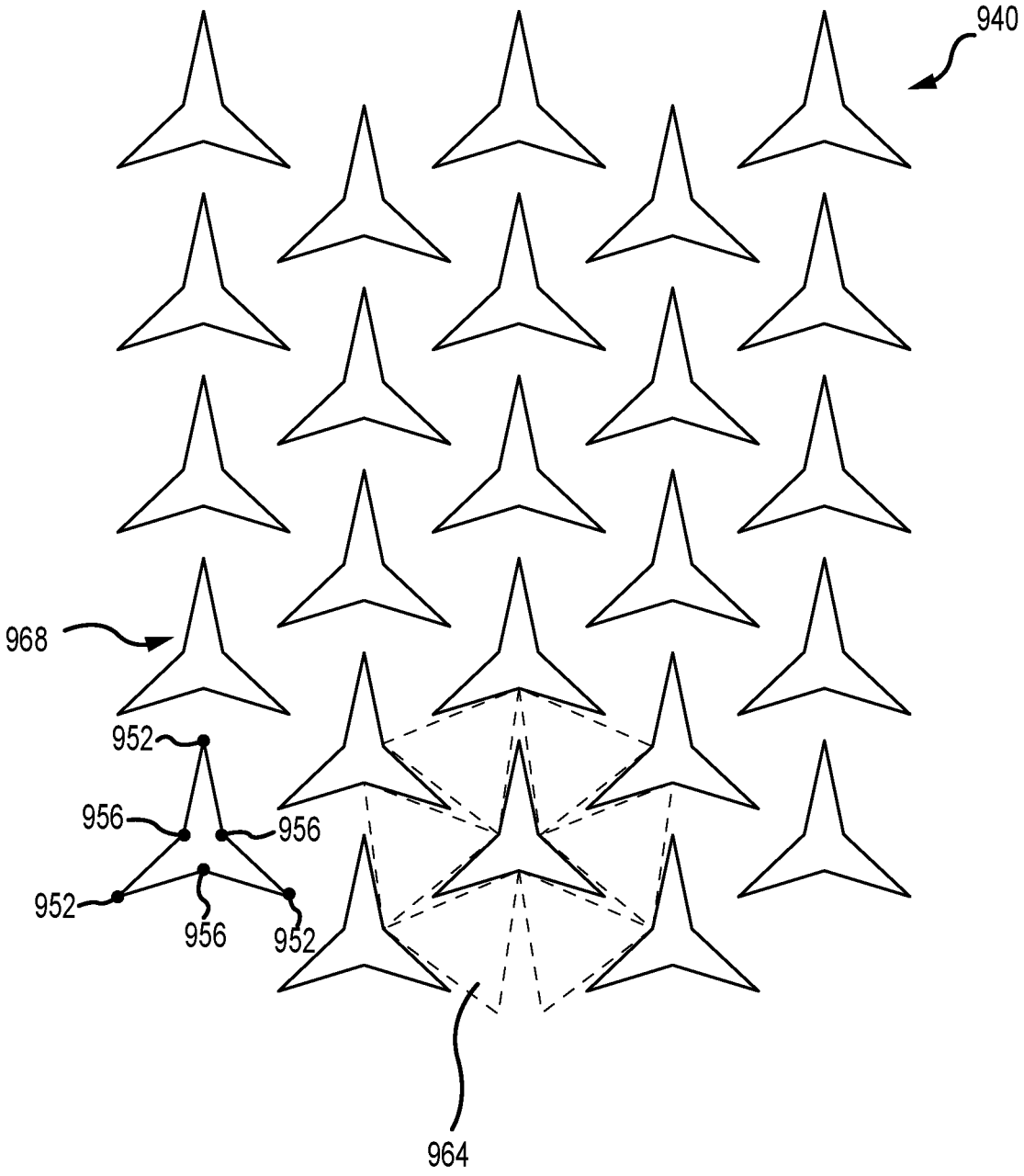
FIG. 14 illustrates a portion of a faceplate lattice according to an embodiment.

In another example, as illustrated in FIG. 14, the faceplate 130 can comprise a lattice 940. The lattice 940 can be similar to lattice 140 described above, but can differ in size, shape, or dimensions. A plurality of land portions 964 can form a plurality of three-pointed star flexure shape recesses 968. Each three-pointed star flexure shape recess 968 can comprise three vertices 952 that define acute interior angles, and three vertices 756 that define reflex angles.

As illustrated in FIG. 14, the three-pointed star flexure shape recess 968 can comprise a substantially triangular shape, star shape, or Y-shape. A minimum width of the three-pointed star flexure shape recess 968 can be measured between opposite reflex angle vertices 956 (i.e. reflex angle vertices 956 having the recess or void between them). A maximum width of the three-pointed star flexure shape recess 968 can be measured between an acute interior angle vertex 952 and a reflex angle vertex 956 (i.e. between an acute interior angle vertex 952 and a reflex angle vertex 956 having the recess or void between them). As described above, the width of the three-pointed star flexure shape recess 968 can be greater than 0.08 inch, greater than 0.1 inch, greater than 0.12 inch, greater than 0.14 inch, greater than 0.16 inch, greater than 0.18 inch, or greater than 0.2 inch. In some embodiments, as described above, the width of the three-pointed flexure shape recess 968 can range from 0.1 to 0.3 inch. In one example, the width of the three-pointed flexure shape recess 968 can be 0.125 inch.

The width of the land portions 964 can correspond with the width of the three-pointed star flexure shape recess 968. In this example, the width of the land portions 964 can vary along a portion of the perimeter of the three-pointed star flexure shape recess 968. More specifically, the minimum width of the land portions 964 can be measured between the reflex angle vertex 956 on a flexure shape recess 968 and the acute interior angle vertex 952 on an adjacent flexure shape recess 968.

Further, as described above, the width of the land portion 964 can be greater than 0.02 inch, greater than 0.05 inch, greater than 0.1 inch, greater than 0.15 inch, or greater than 0.2 inch. In some embodiments, as described above, the width of the land portion 964 can range from 0.02 to 0.2 inch.

The plurality of flexure shape recesses of the lattice 540, 640, 740, 840, and 940 (hereafter "the lattice") formed from the plurality of land portions affects the faceplate bending during golf ball impacts. During golf ball impacts, the flexure shape recesses of the lattice resemble springs storing energy through tension and torsion loads. As the golf ball impacts the faceplate, the strike face is in compression and the back face is in tension. As tension is applied to the back face, the flexure shape recesses expand at the reflex angle vertices (i.e. the flexure shape recesses increase in size or volume). This expansion allows the flexure shape recesses to store energy in the faceplate through linear and torsional bending (i.e. similar to a spring storing energy through tension and torsion). Storing energy through two modes of bending is advantageous over conventional club head faceplates that store energy through one mode of bending (i.e. linear bending). Storing energy though two modes of bending allows for greater ball speeds during golf ball impacts.

Further, the flexure shapes of the lattice reduce the largest stresses concentrated in a small volume of the faceplate material (i.e. impact area of the faceplate) by displacing the reduced stress over a greater volume of the faceplate material. For example, the reduced stress can be displaced over 3 to 8 flexure shape recesses in a direction from near the faceplate center 132 to near the faceplate perimeter 136 in the lattice 540, 640, 740, 840, or 940. In some embodiments, the reduced stress can be displaced over 3 to 5, 4 to 6, 5 to 7, or 6 to 8 flexure shape recesses in a direction from near the faceplate center 132 to near the faceplate perimeter 136. This reduction in stress does not occur in a faceplate devoid of lattice 540, 640, 740, 840, or 940.

Flexure Shape Recesses Defined by Land Portions with Geometric Shapes

As discussed above, the lattice can comprise a plurality of flexure shapes that are formed from a plurality of land portions. The plurality of land portions can form a plurality of flexure shape recesses, where the plurality of land portions separate the plurality of flexure shape recesses. The land portions are interconnected with one another and define the portions of the club head 100 that are devoid of the flexure shape recesses. The land portions form a perimeter of the flexure shape recesses. In some embodiments, the perimeter of the flexure shape recess can comprise a reentrant, concave, or non-convex shape. In other embodiments, the perimeter of the flexure shape recess can be devoid of a reentrant, concave, non-convex shape.

The land portions can comprise a geometric shape between adjacent flexure shape recesses. The geometric shape of the land portions can comprise a triangle, a square, a rectangle, a rhombus, a parallelogram, a quadrilateral, a polygon, or a hexagon. The geometric shape of the land portions can be interconnected with one another, where the land portions form a series of interconnected geometric shapes between the flexure shape recesses.

The geometric shape of the land portion can form a portion of one or more flexure shape recesses. For example, a land portion can comprise a triangular shape that forms a portion of three flexure shape recesses. In another example, a land portion can comprise a quadrilateral shape that forms a portion of four flexure shape recesses.

The land portions can comprise a width between adjacent flexure shape recesses. The land portion width can be measured from a flexure shape recess perimeter to an adjacent flexure shape recess perimeter. The land portion width can vary or remain constant between adjacent flexure shape recesses. Adjacent land portion widths can be similar or different from each other. For example, the land portion width can remain constant along one portion of the flexure shape recess perimeter, and the land portion width can vary along another portion of the flexure shape recess perimeter.

In some embodiments, the land portion width can be greater than 0.02 inch, greater than 0.05 inch, greater than 0.1 inch, greater than 0.15 inch, or greater than 0.2 inch. In some embodiments, the land portion width can range from 0.02 to 0.2 inch. In some embodiments, the land portion width can range from 0.02 to 0.1 inch, or 0.1 to 0.2 inch. In some embodiments, the land portion width can range from 0.02 to 0.05 inch, 0.05 to 0.08 inch, 0.08 to 0.11 inch, 0.11 to 0.14 inch, 0.14 to 0.17 inch, or 0.17 to 0.2 inch. For example, the land portion width can be 0.02, 0.03, 0.04, 0.05, 0.06, 0.08, 0.09, 0.1, 0.11, 0.12, 0.13, 0.14, 0.15, 0.16, 0.17, 0.18, 0.19, or 0.2 inch.

The flexure shape recess can comprise a width. The flexure shape recess width can be greater than 0.08 inch, greater than 0.1 inch, greater than 0.12 inch, greater than 0.14 inch, greater than 0.16 inch, greater than 0.18 inch, or greater than 0.2 inch. In some embodiments, the flexure shape recess width can range from 0.1 to 0.3 inch. In some embodiments, the flexure shape recess width can range from 0.1 to 0.2, or 0.2 to 0.3 inch. For example, the flexure shape recess width can be 0.1, 0.11, 0.12, 0.125, 0.13, 0.14, 0.15, 0.16, 0.17, 0.18, 0.19, 0.2, 0.25, or 0.3 inch.

The lattice comprising the flexure shape recesses formed from the plurality of land portions facilitates in storing greater energy in the faceplate to allow for greater ball speed during golf ball impacts. Described below are four examples of lattices comprising land portions with geometric shapes and flexure shape recesses. The flexure shape recess examples described below are in reference to one orientation, but it would be appreciated that the flexure shape recesses can be oriented in several different configurations to achieve greater faceplate energy storage and greater ball speed during golf ball impacts.

Land Portions with Triangle Shapes

In one example, as illustrated in FIG. 14 and as described above, the faceplate 130 can comprise the lattice 940. The lattice 940 can be similar to lattice 140 described above, but can differ in size, shape, or dimensions. The plurality of land portions 964 can form a plurality of three-pointed star flexure shape recesses 968. The three-pointed star flexure shape recesses 968 can comprise a reentrant, concave, or non-convex shape. The land portions 964 can comprise a triangular shape. In this example, six land portions 964 having the triangular shape can form one flexure shape recess 968. The land portions 964 can comprise a series of interconnected triangular shapes.

In another example, as illustrated in FIG. 15, the faceplate 130 can comprise a lattice 1040. The lattice 1040 can be similar to lattice 140 described above, but can differ in size, shape, or dimensions. The lattice 1040 can be similar to lattice 940 described above but differ in shape geometry. A plurality of land portions 1064 can form a plurality of triad flexure shape recesses 1068. The triad flexure shape recesses 1068 can comprise a reentrant, concave, or non-convex shape. The triad flexure shape recesses 1068 can comprise a substantially triangular shape with rounds (i.e. the perimeter of the triad flexure shape recess 1068 is more rounded than flexure shape recess 968).

The land portions 1064 can comprise a substantially triangular shape. In this example, six land portions 1064 having the substantially triangular shape can form one flexure shape recess 1068. The land portions 1064 can comprise a series of interconnected triangular shapes, similar to the lattice 940 described above. As described above, the width of the land portions 1064 can be greater than 0.02 inch, greater than 0.05 inch, greater than 0.1 inch, greater than 0.15 inch, or greater than 0.2 inch. In some embodiments, as described above, the width of the land portions 1064 can range from 0.02 to 0.2 inch.

As described above, the width of the triad flexure shape recess 1068 can be greater than 0.08 inch, greater than 0.1 inch, greater than 0.12 inch, greater than 0.14 inch, greater than 0.16 inch, greater than 0.18 inch, or greater than 0.2 inch. In some embodiments, as described above, the width of the triad flexure shape recess 1068 can range from 0.1 to 0.3 inch. In one example, the width of the triad flexure shape recess 1068 can be 0.125 inch.

The triad flexure shape recess 1068 can comprise a radius. The radius of the triad flexure shape recess 1068 can range from 0.01 to 0.05 inch. In some embodiments, the radius of the triad flexure shape recess 1068 can range from 0.01 to 0.025 inch, or 0.025 to 0.05 inch. For example, the radius of the triad flexure shape recess 1068 can be 0.01, 0.011, 0.02, 0.03, 0.04, or 0.05 inch. In one example, the triad flexure shape recess 1068 can comprise three radii with a value of 0.011 inch.

Land Portions with Quadrilateral Shapes

In another example, as illustrated in FIG. 16, the faceplate 130 can comprise a lattice 1140. The lattice 1140 can be similar to lattice 140 described above, but differ in size, shape, or dimensions. A plurality of land portions 1164 can form a plurality of diamond flexure shape recesses 1168. The diamond flexure shape recesses 1168 can have a convex shape. More specifically, the diamond flexure shape recesses 1168 can comprise a diamond, a rectangle, a rhombus, a parallelogram, or any quadrilateral shape. The land portions 1164 can comprise a square shape. In other embodiments, the land portions 1164 can comprise a rectangle, a rhombus, a parallelogram, or any quadrilateral shape.

In this example, four land portions 1164 having the square shape can form one flexure shape recess 1168. The land portions 1164 can comprise a series of interconnected square shapes.

The width of the land portions 1164 can correspond with the width of the diamond flexure shape recesses 1168. The width of the land portions 1164 can remain constant between adjacent diamond flexure shape recesses 1168. As described above, the width of the land portions 1164 can be greater than 0.02 inch, greater than 0.05 inch, greater than 0.1 inch, greater than 0.15 inch, or greater than 0.2 inch. In some embodiments, as described above, the width of the land portions 1164 can range from 0.02 to 0.2 inch.

As described above, the width of the diamond flexure shape recess 1168 can be greater than 0.08 inch, greater than 0.1 inch, greater than 0.12 inch, greater than 0.14 inch, greater than 0.16 inch, greater than 0.18 inch, or greater than 0.2 inch. In some embodiments, as described above, the width of the diamond flexure shape recess 1168 can range from 0.1 to 0.3 inch. In one example, the width of the diamond flexure shape recess 1168 can be 0.125 inch.

Land Portions with Hexagon Shapes

In another example, as illustrated in FIG. 17, the faceplate 130 can comprise a lattice 1240. The lattice 1240 can be similar to lattice 140 described above, but differ in size, shape, or dimensions. A plurality of land portions 1264 can form a plurality of slot flexure shape recesses 1268. The slot flexure shape recesses 1268 can comprise a shape that resembles a slot, or a rectangle with rounded ends. The slot flexure shape recesses 1268 can comprise a convex shape. The land portions 1264 can comprise a hexagon shape.

In this example, five slot flexure shape recesses 1268 can be arranged to form one land portion 1264 with the hexagon shape. The slot flexure shape recesses 1268 can be arranged to form a plurality of interconnected land portions 1264 that have a hexagon shape.

As described above, the width of the land portions 1264 can be greater than 0.02 inch, greater than 0.05 inch, greater than 0.1 inch, greater than 0.15 inch, or greater than 0.2 inch. In some embodiments, as described above, the width of the land portions 1264 can range from 0.02 to 0.2 inch.

As described above, the width of the slot flexure shape recess 1268 can be greater than 0.08 inch, greater than 0.1 inch, greater than 0.12 inch, greater than 0.14 inch, greater than 0.16 inch, greater than 0.18 inch, or greater than 0.2 inch. In some embodiments, as described above, the width of the slot flexure shape recess 1268 can range from 0.1 to 0.3 inch. In one example, the width of the slot flexure shape recess 1268 can be 0.125 inch.

The plurality of flexure shape recesses of the lattice 940, 1040, 1140, or 1240 (hereafter "the lattice") formed from the plurality of land portions with geometric shapes affects the faceplate bending during golf ball impacts. During golf ball impacts, the land portions of the lattice resemble springs storing energy through tension and torsion loads. As the golf ball impacts the faceplate 130, the strike face 134 is in compression and the back face 138 is in tension. As tension is applied to the back face 138, the land portions deflect linearly and rotational. This linear and rotational movement allows the land portions to store energy in the faceplate 130 through linear and torsional bending (i.e. similar to a spring storing energy through tension and torsion). Storing energy through two modes of bending is advantageous over conventional club head faceplates that store energy through one mode of bending (i.e. linear bending). Storing energy though two modes of bending allows for greater ball speeds during golf ball impacts.

Further, the flexure shapes of the lattice reduce the largest stresses concentrated in a small volume of the faceplate material (i.e. impact area of the faceplate) by displacing the reduced stress over a greater volume of the faceplate material. For example, the reduced stress can be displaced over 3 to 8 land portions in a direction from near the faceplate center 132 to near the faceplate perimeter 136 in the lattice 1040, 1140, or 1240. In some embodiments, the reduced stress can be displaced over 3 to 5, 4 to 6, 5 to 7, or 6 to 8 land portions in a direction from near the faceplate center 132 to near the faceplate perimeter 136. This reduction in stress does not occur in a faceplate devoid of lattice 1040, 1140, or 1240.

Method of Manufacturing Golf Club Head Faceplates with Lattices

A method of manufacturing a club head 100 having a faceplate 130 with a lattice described in this disclosure is provided. The method includes providing a body 110 and a faceplate 130, where the faceplate 130 is coupled with the body 110 to define a substantially hollow/closed structure. The body 110 can be created or formed by casting, forging, machining, electro-discharging machining (EDM), chemical etching, additive manufacturing, 3D printing, or any suitable method or combination thereof. In some embodiments, the faceplate 130 can be welded onto the body 110. In other embodiments, the faceplate 130 and the body 110 can be formed together as one integral piece.

Further, the faceplate 130 with the lattice can be created or formed by electro-discharging machining (EDM), chemical etching, additive manufacturing, 3D printing, or any combination thereof. In one embodiment, the faceplate 130 can be formed from additive manufacturing methods such as powdered metal sintering. The powdered metal sintering system involves a bed of metal powder that is sintered or melted layer by layer by a heated source such as a laser. The layer by layer technique forms a three-dimensional faceplate 130 with the lattice from the layered metal.

The advantages of using these methods to form the faceplate 130 lattice is to minimize large stress concentrations in the faceplate 130 during golf ball impacts. In particular, these methods provide small fillets (e.g. 0.015 to 0.05 inch) on the edges of the lattice rather than squared or sharp edges. Methods such as milling or end milling are not advantageous in forming the lattice because these methods form square or sharp edges, which creates a high degree of stress concentration within the lattice and leads to failures of the faceplate 130 during golf ball impacts.

EXAMPLES

Example 1—Coefficient of Restitution (COR) Faceplate Test

An exemplary faceplate 130 comprising a lattice and a variable face thickness was compared to a similar control faceplate, but devoid of a lattice. The exemplary faceplate 130 comprises a variable faceplate thickness including a faceplate perimeter thickness of 0.09 inch, a faceplate center thickness of 0.20 inch, a lattice depth of 0.05 inch, and the lattice 1040 with the triad flexure shape recesses 1068. The control faceplate comprises a variable faceplate thickness including a faceplate perimeter thickness of 0.09 inch, a faceplate center thickness of 0.20 inch. The exemplary faceplate 130 and the control faceplate comprise a titanium alloy (i.e. Ti-6-4).

A test was conducted to compare the coefficient of restitution (COR) between the exemplary faceplate 130 and the control faceplate. The coefficient of restitution (COR) is the ratio of the final to initial velocity between the collision of the golf ball and the faceplate. The test used an air cannon that fired golf balls at each faceplate. The distance the air cannon was positioned from each faceplate was held constant, and each faceplate was held in a fixed position. The test resulted in the exemplary faceplate 130 averaging a COR value of 0.827 and the control faceplate averaging a COR value of 0.795. The results show that the exemplary faceplate 130 had on average a 3.54% increase in COR over the control faceplate. The lattice of the exemplary faceplate 130 allows for energy storage through two modes of bending (i.e. linear and torsional) thereby increasing the COR to provide greater ball speeds during golf ball impacts.

Example 2—Internal Energy Faceplate Test

An exemplary faceplate 130 comprising a lattice and a variable face thickness was compared to a similar control faceplate, but devoid of a lattice and a variable face thickness. The exemplary faceplate 130 comprises a variable faceplate thickness including a faceplate perimeter thickness of 0.09 inch, a faceplate center thickness of 0.20 inch, a lattice depth of inch. The control faceplate comprises a constant faceplate thickness of 0.115 inch (USGA standard faceplate).

A test was conducted to compare the internal energy between the exemplary faceplate 130 and the control faceplate. The test used finite element simulations that modeled an impact of a golf ball on the striking surface with a ball speed ranging from 90 to 115 mph. The internal energy is measured in lbf-inch. The test resulted in the exemplary faceplate 130 having an internal energy of 80 to 82 lbf-inch and the control faceplate having an internal energy of 71 lbf-inch. The results show that the exemplary faceplate 130 had a 10% to 15% increase in internal energy. This internal energy increase equates to a ball speed increase of approximately 1 to 3 mph. The lattice of the exemplary faceplate 130 allows for greater energy storage by storing energy through two modes of bending (i.e. linear and torsional), which allows for greater ball speeds during golf ball impacts.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Clause 1. A golf club head comprising: a faceplate comprising a lattice, the lattice comprises a plurality of grooves arranged in a sunburst pattern, each sunburst groove comprises: a base groove; and a plurality of ligament grooves, the plurality of ligament grooves connected to the base groove and extending outward from the base groove; wherein the base groove comprises a circular shape; wherein the ligament groove comprises at least one curve; and wherein at least three sunburst grooves form a flexure shape, the flexure shape comprises a portion of at least three base grooves and at least three ligament grooves to form a series of convex and concave curves relative to a center of the flexure shape; and wherein the series of convex and concave curves of the flexure shape flex during golf ball impacts to store energy through linear and torsional bending.

Clause 2. The golf club head of clause 1, wherein the plurality of sunburst grooves comprises a repeating pattern of flexure shapes interspersed in a repeating pattern of circular shapes.

Clause 3. The golf club head of clause 1, wherein the flexure shape comprises a reentrant shape.

Clause 4. The golf club head of clause 2, wherein the plurality of flexure shapes are positioned on a faceplate region selected from the group consisting of a center region, a toe region, a heel region, a top region, a bottom region, a high-toe region, a low-toe region, a high-heel region, and a low-heel region.

Clause 5. The golf club head of clause 1, wherein the plurality of ligament grooves are equally spaced along the base groove.

Clause 6. The golf club head of clause 1, wherein the base groove comprises a width ranging from 0.01 inch to 0.05 inch.

Clause 7. The golf club head of clause 1, wherein the ligament groove comprises a width ranging from 0.01 inch to 0.05 inch.

Clause 8. The golf club head of clause 1, wherein a depth of the plurality of grooves ranges from 0.025 inch to 0.075 inch.

Clause 9. A golf club head comprising: a faceplate comprising a lattice, the lattice comprises a plurality of grooves arranged in a sunburst pattern, each sunburst groove comprises: a base groove; and a plurality of ligament grooves, the plurality of ligament grooves connected to the base groove and extending outward from the base groove; wherein the base groove comprises a circular shape; wherein the ligament grooves comprise at least one curve; wherein at least three sunburst grooves form a flexure shape, the flexure shape comprises a portion of at least three base grooves and at least three ligament grooves to form a series of convex and concave curves relative to a center of the flexure shape; wherein the plurality of sunburst grooves comprises a repeating pattern of interconnected flexure shapes; and wherein the series of convex and concave curves of the flexure shape flex during golf ball impacts to store energy through linear and torsional bending.

Clause 10. The golf club head of clause 9, wherein the plurality of flexure shapes are positioned on a faceplate region selected from the group consisting of a center region, a toe region, a heel region, a top region, a bottom region, a high-toe region, a low-toe region, a high-heel region, and a low-heel region.

Clause 11. The golf club head of clause 9, wherein the flexure shapes comprise a reentrant shape.

Clause 12. The golf club head of clause 9, wherein adjacent flexure shapes share at least one ligament groove.

Clause 13. The golf club head of clause 9, wherein the ligament grooves comprise a width ranging from 0.01 inch to 0.05 inch.

Clause 14. The golf club head of clause 9, wherein a depth of the plurality of grooves ranges from 0.025 inch to 0.075 inch.

Clause 15. A golf club head comprising: a faceplate comprising a lattice, the lattice comprises a plurality of grooves arranged in a sunburst pattern, each sunburst groove comprises: a base groove; and a plurality of ligament grooves, the plurality of ligament grooves connected to the base groove and extending outward from the base groove; wherein the base groove comprises a circular shape; wherein the ligament groove comprises a first curve, a second curve, and an inflection point positioned between the first curve and the second curve; wherein at least three sunburst grooves form a flexure shape, the flexure shape comprises a portion of at least three base grooves and at least three ligament grooves to form a series of convex and concave curves relative to a center of the flexure shape; wherein the flexure shape comprises a reentrant shape; and wherein the series of convex and concave curves of the flexure shape flex during golf ball impacts to store energy through linear and torsional bending.

Clause 16. The golf club head of clause 15, wherein the plurality of sunburst grooves comprises a repeating pattern of flexure shapes interspersed in a repeating pattern of circular shapes.

Clause 17. The golf club head of clause 15, wherein the plurality of flexure shape recesses are positioned on a faceplate region selected from the group consisting of a center region, a toe region, a heel region, a top region, a bottom region, a high-toe region, a low-toe region, a high-heel region, and a low-heel region.

Clause 18. The golf club head of clause 15, wherein the ligament groove comprises a width ranging from 0.01 inch to 0.05 inch.

Clause 19. The golf club head of clause 18, wherein the first curve and the second curve of the ligament groove comprise a similar width.

Clause 20. The golf club head of clause 15, wherein a depth of the plurality of grooves ranges from 0.025 inch to 0.075 inch.

Clause 21. The golf club head of clause 1, wherein the plurality of flexure shapes increase in size toward a faceplate region selected from the group consisting of a center region, a toe region, a heel region, a top region, a bottom region, a high-toe region, a low-toe region, a high-heel region, and a low-heel region.

Clause 22. The golf club head of clause 1, wherein the number of flexure shapes increase toward a faceplate region selected from the group consisting of a center region, a toe region, a heel region, a top region, a bottom region, a high-toe region, a low-toe region, a high-heel region, and a low-heel region.

Clause 23. A golf club head comprising: a faceplate comprising a lattice, the lattice comprises a plurality of land portions that form a plurality of flexure shape recesses, the plurality of flexure shape recesses comprises: at least two vertices that define acute interior angles; and at least one vertex defining a reflex angle; wherein: the land portions are interconnected with one another and define portions of the club head that are devoid of the flexure shape recesses; and the land portions separate the flexure shape recesses.

Clause 24. The golf club head of clause 23, wherein the reflex angle defines at least one concave portion on the flexure shape recess.

Clause 25. The golf club head of clause 23, wherein the flexure shape recess comprises two vertices that define a reflex angle, wherein the two reflex angles defines two concave portions on the flexure shape recess.

Clause 26. The golf club head of clause 23, wherein the acute interior angle defines an angle less than 90 degrees, and the reflex angle defines an angle greater than 180 degrees and less than 360 degrees.

Clause 26. A golf club head comprising: a faceplate comprising a lattice, the lattice comprises a plurality of land portions that form a plurality of flexure shape recesses, the plurality of land portions comprises: a geometric shape; wherein: the land portions are interconnected with one another, where the land portions separate the flexure shape recesses; and the land portions comprise a series of interconnected geometric shapes between the flexure shape recesses.

Clause 27. The golf club head of clause 26, wherein the geometric shape of the land portions is selected form the group consisting of a triangle, a square, a rectangle, a rhombus, a parallelogram, a quadrilateral, a polygon, and a hexagon.

Various features and advantages of the disclosure are set forth in the following claims.

What is claimed is:

1. A golf club head comprising:

a faceplate comprising a lattice, the lattice comprises a plurality of land portions that form a plurality of flexure shape recesses;

wherein:

each land portion of the plurality of land portions is interconnected and defines portions of the faceplate devoid of the plurality of flexure shape recesses;

each flexure shape recess of the plurality of flexure shape recesses comprises at least four vertices defining an acute interior angle, and a first vertex defining a first reflex angle; and the first reflex angle does not define an acute interior angle; and each flexure shape recess of the plurality of flexure shape recesses defines a depth from 0.025 inch to 0.075 inch.

2. The golf club head of claim 1, wherein the first reflex angle is greater than 180 degrees and less than 360 degrees.

3. The golf club head of claim 1, wherein the plurality of flexure shape recesses are positioned on a faceplate region selected from the group consisting of a center region, a toe region, a heel region, a top region, a bottom region, a high-toe region, a low-toe region, a high-heel region, and a low-heel region.

4. The golf club head of claim 1, wherein each flexure shape recess of the plurality of flexure shape recesses further comprises a second vertex defining a second reflex angle.

5. The golf club head of claim 4, wherein a second reflex angle vertex does not define an acute interior angle.

6. The golf club head of claim 5, wherein a width of each flexure shape recess of the plurality of flexure shape recesses decreases from each acute interior angle vertex to each reflex angle vertex.

7. The golf club head of claim 5, wherein a width of each flexure shape recess of the plurality of flexure shape recesses is greater between each acute interior angle vertex than between a first reflex angle vertex and the second reflex angle vertex.

8. The golf club head of claim 7, wherein a width of each land portion of the plurality of land portions located between two adjacent flexure shape recesses increases from each acute interior angle vertex of at least four acute interior angle vertices to the first reflex angle vertex and the second reflex angle vertex of two adjacent flexure shape recesses.

9. The golf club head of claim 7, wherein a width of each land portion of the plurality of land portions is greater between the first reflex angle and the second reflex angle of two adjacent flexure shape recesses than at each acute interior angle vertex of two adjacent flexure shape recesses.

10. The golf club head of claim 4, wherein a width of each land portion of the plurality of land portions is less between each acute interior angle vertex of two adjacent flexure shape recesses than at the first reflex angle and the second reflex angle of two adjacent flexure shape recesses.

11. A golf club head comprising:

a faceplate comprising a lattice, the lattice comprises a plurality of land portions that form a plurality of flexure shape recesses;

wherein:

each land portion of the plurality of land portions are interconnected and defines portions of the faceplate devoid of the plurality of flexure shape recesses;

each flexure shape recess of the plurality of flexure shape recesses defines a depth from 0.025 inch to 0.075 inch; and each flexure shape recess of the plurality of flexure shape recesses comprises at least four vertices defining an acute interior angle, and at least two vertices defining a reflex angle.

12. The golf club head of claim 11, wherein the reflex angle of each of the at least two vertices is greater than 180 degrees and less than 360 degrees.

13. The golf club head of claim 11, wherein the plurality of flexure shape recesses are positioned on a faceplate region selected from the group consisting of a center region, a toe region, a heel region, a top region, a bottom region, a high-toe region, a low-toe region, a high-heel region, and a low-heel region.

14. The golf club head of claim 12, wherein a minimum width of each flexure shape recess of the plurality of flexure shape recesses is measured across the reflex angle of each of the at least two vertices.

15. The golf club head of claim 12, wherein a width of each flexure shape recess of the plurality of flexure shape recesses decreases from each acute interior angle vertex to each reflex angle vertex.

16. The golf club head of claim 12, wherein a width of each flexure shape recess of the plurality of flexure shape recesses is greater between each acute interior angle vertex than between the reflex angle of each of the at least two vertices.

17. The golf club head of claim 12, wherein a width of each land portion of the plurality of land portions located between two adjacent flexure shape recesses increases from each acute interior angle vertex of at least four acute interior angle vertices to at least two reflex angle vertices of two adjacent flexure shape recesses.

18. The golf club head of claim 12, wherein a width of each land portion of the plurality of land portions is greater between the reflex angle of each of the at least two vertices of two adjacent flexure shape recesses than at each acute interior angle vertex of two adjacent flexure shape recesses.

19. The golf club head of claim 12, wherein a width of each land portion of the plurality of land portions is less between acute interior angle vertices of two adjacent flexure shape recesses than at the reflex angle of each of the at least two vertices of two adjacent flexure shape recesses.

* * * * *